US007985053B2

(12) United States Patent
Schott et al.

(10) Patent No.: US 7,985,053 B2
(45) Date of Patent: Jul. 26, 2011

(54) INLET GUIDE VANE

(75) Inventors: Carl Gerard Schott, Simpsonville, SC (US); Marc Edward Blohm, Greenville, SC (US); Venkata Siva Chaluvadi, Simpsonville, SC (US); Anthony Constantine Thermos, Greer, SC (US)

(73) Assignee: General Electric Company, Schenectady, NY (US)

( * ) Notice: Subject to any disclaimer, the term of this patent is extended or adjusted under 35 U.S.C. 154(b) by 530 days.

(21) Appl. No.: 12/209,416

(22) Filed: Sep. 12, 2008

(65) Prior Publication Data

US 2010/0068045 A1 Mar. 18, 2010

(51) Int. Cl.
*F01D 9/02* (2006.01)

(52) U.S. Cl. ..... 416/223 A

(58) Field of Classification Search ..... None
See application file for complete search history.

(56) References Cited

U.S. PATENT DOCUMENTS

| | | | | |
|---|---|---|---|---|
| 6,457,938 | B1 | 10/2002 | Liu et al. | |
| 6,543,997 | B2 | 4/2003 | Donnaruma et al. | |
| 6,619,916 | B1 | 9/2003 | Capozzi et al. | |
| 6,715,983 | B2 | 4/2004 | Koshoffer et al. | |
| 7,114,911 | B2 | 10/2006 | Martin et al. | |
| 7,186,090 | B2 * | 3/2007 | Tomberg et al. | 416/223 A |
| 7,329,093 | B2 * | 2/2008 | Vandeputte et al. | 416/223 A |
| 2006/0073014 | A1 * | 4/2006 | Tomberg et al. | 416/96 R |
| 2008/0101954 | A1 * | 5/2008 | Latimer et al. | 416/223 R |

* cited by examiner

*Primary Examiner* — Richard Edgar
(74) *Attorney, Agent, or Firm* — Cantor Colburn LLP

(57) ABSTRACT

An inlet guide vane having a nominal profile substantially in accordance with Cartesian coordinate values of x, y, and z set forth in TABLE 1 reduces vibration of engine components at various operating conditions. A scaling factor can be applied to the values to make the airfoil larger or smaller. The TABLE 1 x and y values are distances in inches within a tolerance which, when connected by smooth curves, define airfoil profile sections at each distance z in inches, the profile sections being joined smoothly to form a complete airfoil shape. The tolerance in an embodiment is up to about 0.16 inches.

17 Claims, 6 Drawing Sheets

INLET GUIDE VANE

BACKGROUND

Embodiments of the invention relate to airfoil profiles in gas turbines. More specifically, embodiments of the invention relate to airfoil profiles for inlet guide vanes (IGVs) of gas turbines.

In gas turbines, IGVs condition flow coming into the turbine to enhance efficiency and performance. The IGVs project from the center structure of the inlet, are arranged around the circumference of the turbine inlet, span at least part of the flow path between the inlet inner barrel or center structure and inlet casing, and work in concert with the profile of the inlet itself to deliver flow having desired characteristics to the first rotor of the turbine. For example, incoming flow direction, speed, and pressure can be directed to desired values.

In some gas turbines, the IGVs' angle of attack can be varied to control turbine flow rate. For example, the IGVs in some turbines are mounted on radial shafts that are rotated by actuators in the turbine housing to vary the IGV rotational position and angle of attack. As angle of attack increases, incoming flow rate decreases, and as angle of attack decreases, incoming flow rate increases. It has been observed that in such variable IGV arrangements, vibration of blades downstream of the IGV can vary significantly with changes in flow setting, which could reduce turbine and turbine component life. Investigation revealed that a component of the vibration is induced by non-uniform flow separation of the IGVs, and that at a reduced flow setting, IGV flow separation becomes very sensitive to inlet flow distortions. As a result, IGVs at some locations experience more flow separation than others, and the wakes of IGVs experiencing enhanced flow separation excite certain of the observed frequencies of vibration.

BRIEF DESCRIPTION

Embodiments disclosed herein include an article of manufacture with an airfoil having a nominal profile substantially in accordance with Cartesian coordinate values of x, y, and z set forth in TABLE 1. The airfoil can be produced using the TABLE 1 values and a scaling factor. The TABLE 1 x and y values are distances in inches, within a tolerance, which, when connected by smooth curves, define airfoil profile sections at each distance z in inches, the profile sections at the z distances being joined smoothly with one another to form a complete airfoil shape. As disclosed herein, the airfoil of an embodiment is an inlet guide vane, such as for a gas turbine engine. The tolerance in an embodiment can be 0.16 inches normal to any surface of the airfoil.

An embodiment includes a gas turbine with a plurality of articles of manufacture each including an airfoil produced using coordinate values of x, y, and z set forth in TABLE 1. The TABLE 1 x and y values are distances in inches, within a tolerance, which, when connected by smooth curves, define airfoil profile sections at each distance z in inches, the profile sections at the z distances being joined smoothly with one another to form a complete airfoil shape. As disclosed herein, the airfoil of an embodiment is an inlet guide vane, such as for a gas turbine engine. The tolerance in an embodiment can be 0.16 inches normal to any surface of the airfoil.

An embodiment includes a gas turbine with a plurality of articles of manufacture each including an airfoil having an uncoated nominal airfoil profile substantially in accordance with coordinate values of x, y, and z set forth in TABLE 1. The TABLE 1 x and y values are distances in inches, within a tolerance, which, when connected by smooth curves, define airfoil profile sections at each distance z in inches, the profile sections at the z distances being joined smoothly with one another to form a complete airfoil shape. As disclosed herein, the airfoil of an embodiment is an inlet guide vane, such as for a gas turbine engine. The tolerance in an embodiment can be 0.16 inches normal to any surface of the airfoil.

DETAILED DESCRIPTION

Figure 1:
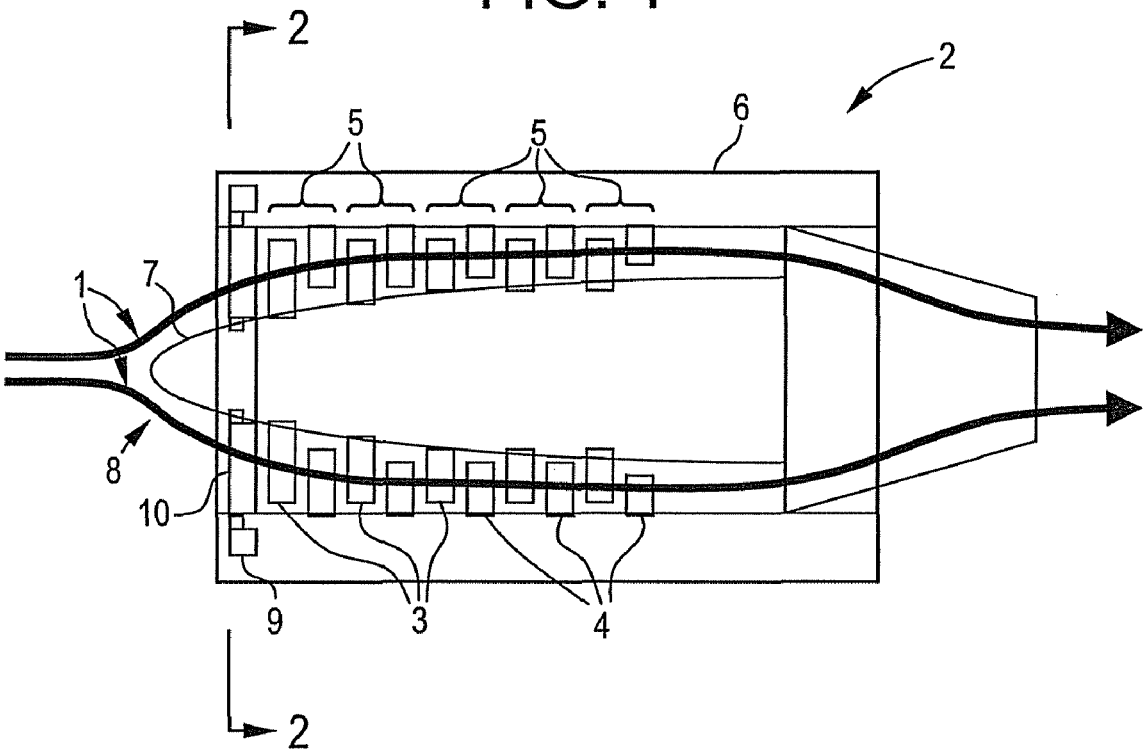
FIG. 1 is a schematic side view of a gas turbine in which an inlet guide vane according to an embodiment of the invention can be used.
Figure 2:
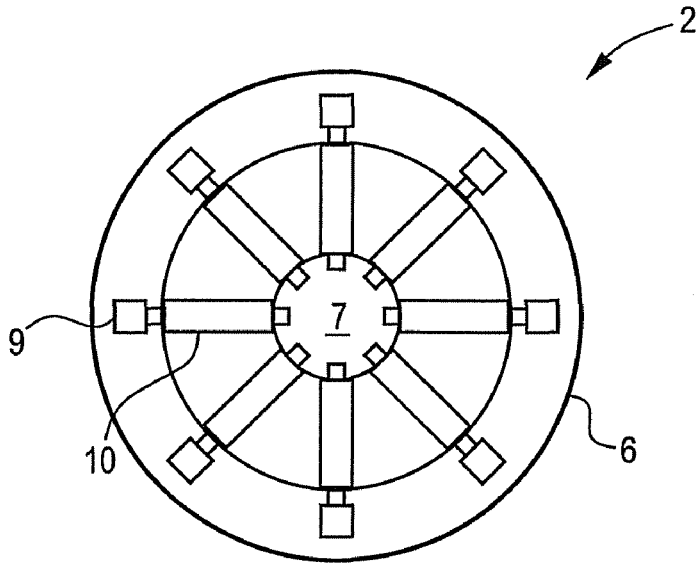
FIG. 2 is a schematic front view of the gas turbine in which an inlet guide vane according to an embodiment of the invention can be used shown in FIG. 1 and taken along the line 2-2.

With reference to the accompanying Figures, examples of an inlet guide vane according to embodiments of the invention are disclosed. For purposes of explanation, numerous specific details are shown in the drawings and set forth in the detailed description that follows in order to provide a thorough understanding of embodiments of the invention. It will be apparent, however, that embodiments of the invention may be practiced without these specific details. In other instances, well-known structures and devices are schematically shown in order to simplify the drawing.

Referring now to the drawings, FIG. 1 illustrates a flow path 1 of a gas turbine 2. The gas turbine 2 includes a compressor including a plurality of airfoils such as, but not limited to, airfoils that are part of alternating rotors 3 and stators 4, each rotor/stator pair 5 comprising a stage of the compressor. The airfoils impart kinetic energy to the airflow and therefore bring about a desired flow across the compressor including a desired pressure rise. Each airfoil has a profile that varies over the length of the blade. The airfoils turn the fluid flow, slow the fluid flow velocity (in the respective airfoil frame of reference), and yield a rise in the static pressure of the fluid flow. The configuration of the airfoil (along with its interaction with surrounding airfoils), as embodied by the invention, including its peripheral surface provides for stage airflow efficiency, enhanced aeromechanics, smooth laminar flow from stage to stage, reduced thermal stresses, enhanced interrelation of the stages to effectively pass the airflow from stage to stage, and reduced mechanical stresses, among other desirable aspects of the invention. Typically, as indicated above, multiple rows of airfoil stages, such as, but not limited to, rotor/stator airfoils, are stacked to achieve a desired discharge to inlet pressure ratio. Airfoils can be secured to wheels or a case by an appropriate attachment configuration, often known as a "root", "base" or "dovetail."

The configuration of the airfoil and any interaction with surrounding airfoils, as embodied by the invention, that provide the desirable aspects fluid flow dynamics and laminar flow of the invention can be determined by various means. For a given airfoil downstream of the inlet guide vanes, fluid flow from a preceding/upstream airfoil intersects with the airfoil, and via the configuration of the instant airfoil, flow over and around the airfoil, as embodied by the invention, is enhanced. In particular, the fluid dynamics and laminar flow from the airfoil, as embodied by the invention, is enhanced. There is a smooth transition fluid flow from the preceding/upstream airfoil(s) and a smooth transition fluid flow to the adjacent/downstream airfoil(s). Moreover, the flow from the airfoil, as embodied by the invention, proceeds to the adjacent/downstream airfoil(s) and is enhanced due to the enhanced laminar fluid flow off of the airfoil, as embodied by the invention. Therefore, the configuration of the airfoil, as embodied by the invention, assists in the prevention of turbulent fluid flow in the unit comprising the airfoil, as embodied by the invention.

For example, but in no way limiting of the invention, the airfoil configuration (with or without fluid flow interaction) can be determined by computational Fluid Dynamics (CFD); traditional fluid dynamics analysis; Euler and Navier-Stokes equations; for transfer functions, algorithms, manufacturing: manual positioning, flow testing (for example in wind tunnels), and modification of the airfoil; in-situ testing; modeling: application of scientific principles to design or develop the airfoils, machines, apparatus, or manufacturing processes; airfoil flow testing and modification; combinations thereof, and other design processes and practices. These methods of determination are merely exemplary, and are not intended to limit the invention in any manner.

As noted above, the airfoil configuration (along with its interaction with surrounding airfoils), as embodied by the invention, including its peripheral surface, provides for stage airflow efficiency, enhanced aeromechanics, smooth laminar flow from stage to stage, reduced thermal stresses, enhanced interrelation of the stages to effectively pass the airflow from stage to stage, and reduced mechanical stresses, among other desirable aspects of the invention, compared to other similar airfoils, which have like applications. Moreover, and in no way limiting of the invention, in conjunction with other airfoils, which are conventional or enhanced (similar to the enhancements herein), the airfoil, as embodied by the invention, provides an increased efficiency compared to previous individual sets of airfoils. This increased efficiency provides, in addition to the above-noted advantages, a power output with a decrease the required fuel, therefore inherently decreasing emissions to produce energy. Of course, other such advantages are within the scope of the invention.

Referring again to FIG. 1, at the inlet 8 of the gas turbine 2, a plurality of inlet guide vanes (IGVs) 10 are arranged about the axis of the gas turbine, spanning at least part of the flow path between the casing 6 and inner barrel or center structure 7. The IGVs 10 condition the airflow by changing its speed and direction in conjunction with the surfaces of the inlet itself. The IGVs 10 are mounted so that their rotational orientation can be changed, such as with an actuator 9, which allows throttling of the gas turbine 2 by varying airflow through the inlet 8 and the rest of the gas turbine 2. Thus, IGVs 10 are mounted in a different manner than rotor and stator blades 3, 4, as is explained below.

Figure 3:
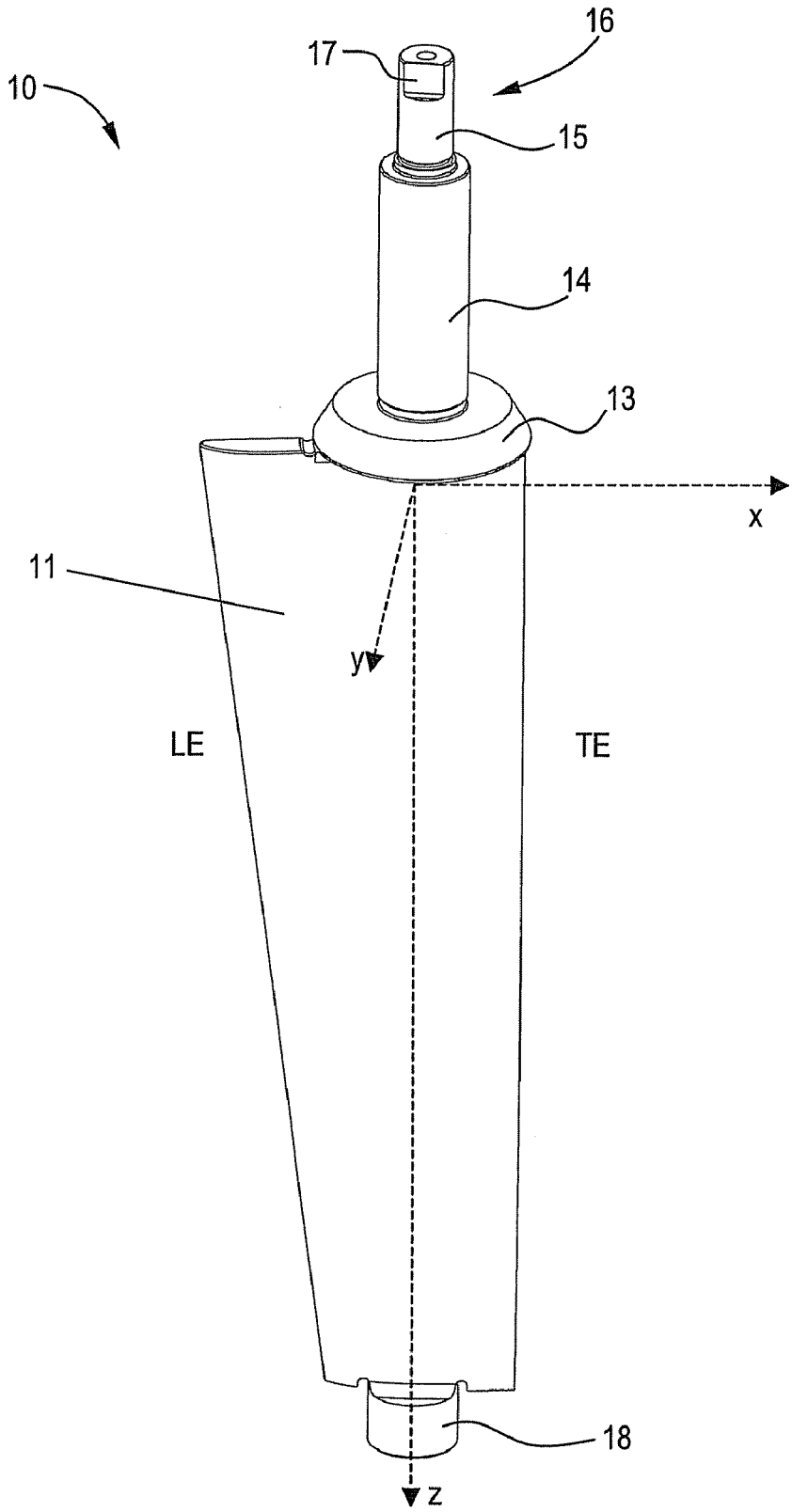
FIG. 3 is a schematic isometric view of an inlet guide vane according to an embodiment of the invention.
Figure 4:
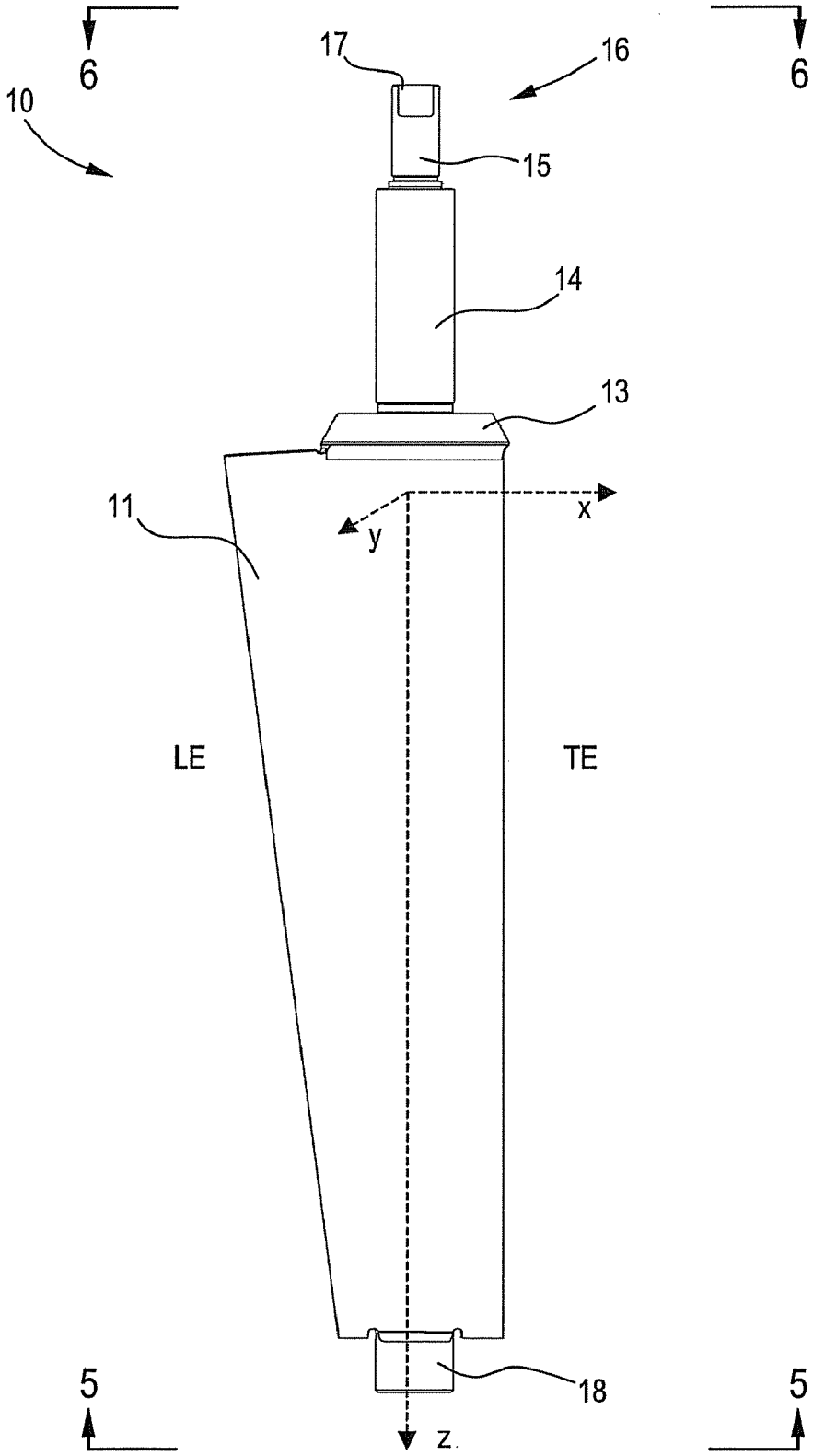
FIG. 4 is a side elevational view of an inlet guide vane according to an embodiment of the invention.
Figure 7:
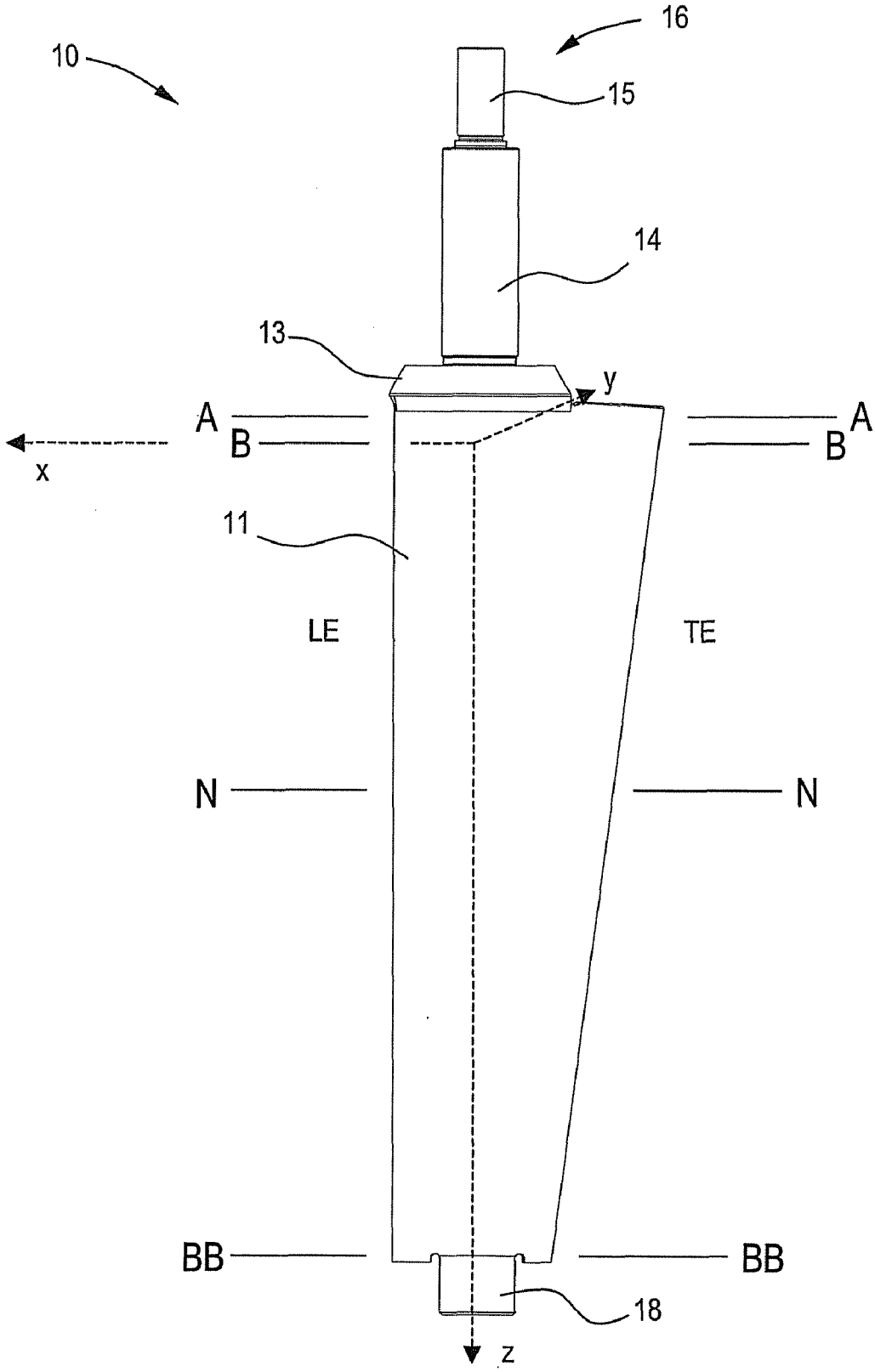
FIG. 7 is a side elevational view of an inlet guide vane according to an embodiment of the invention from the other side of the inlet guide vane of FIG. 4.

With reference to FIGS. 3, 4, and 7, each IGV 10 includes an airfoil 11 whose profile 12 varies along its length as will be described below. At one end of the airfoil is a hub 13 from which projects a top shaft portion 14. The top shaft portion 14 is mounted via a projection 15 in the casing or housing 6 of the gas turbine 2 for rotation about the longitudinal axis z of the top shaft portion. A top end 16 of the projection includes a feature 17, such as a flattened portion, that enables manipulation of the projection 15 and the top shaft portion 14. An actuator 9 interacts with the feature 17 of the projection 15 to change the rotational position of the top shaft portion 14 and the IGV 10. At the other end of the IGV 10 is a bottom shaft portion 18 that is coaxial with the top shaft portion 14. The bottom shaft portion 18 is mounted for rotation about its longitudinal axis z in the inlet portion of the center structure 7.

Figure 5:
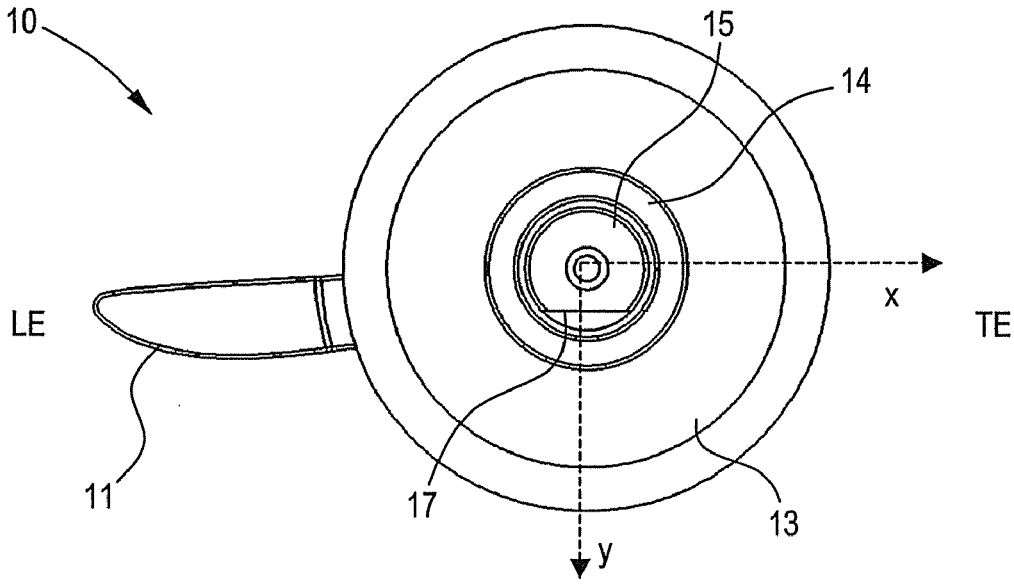
FIGS. 5 and 6 are respective top and bottom elevational views of the inlet guide vane of FIG. 4.
Figure 6:
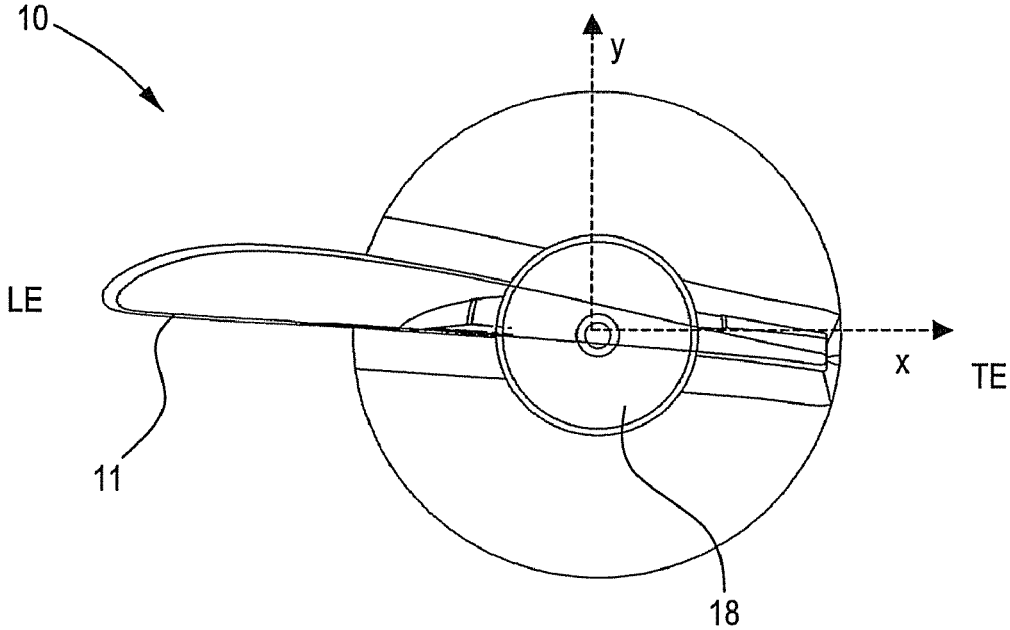
Figure 8:
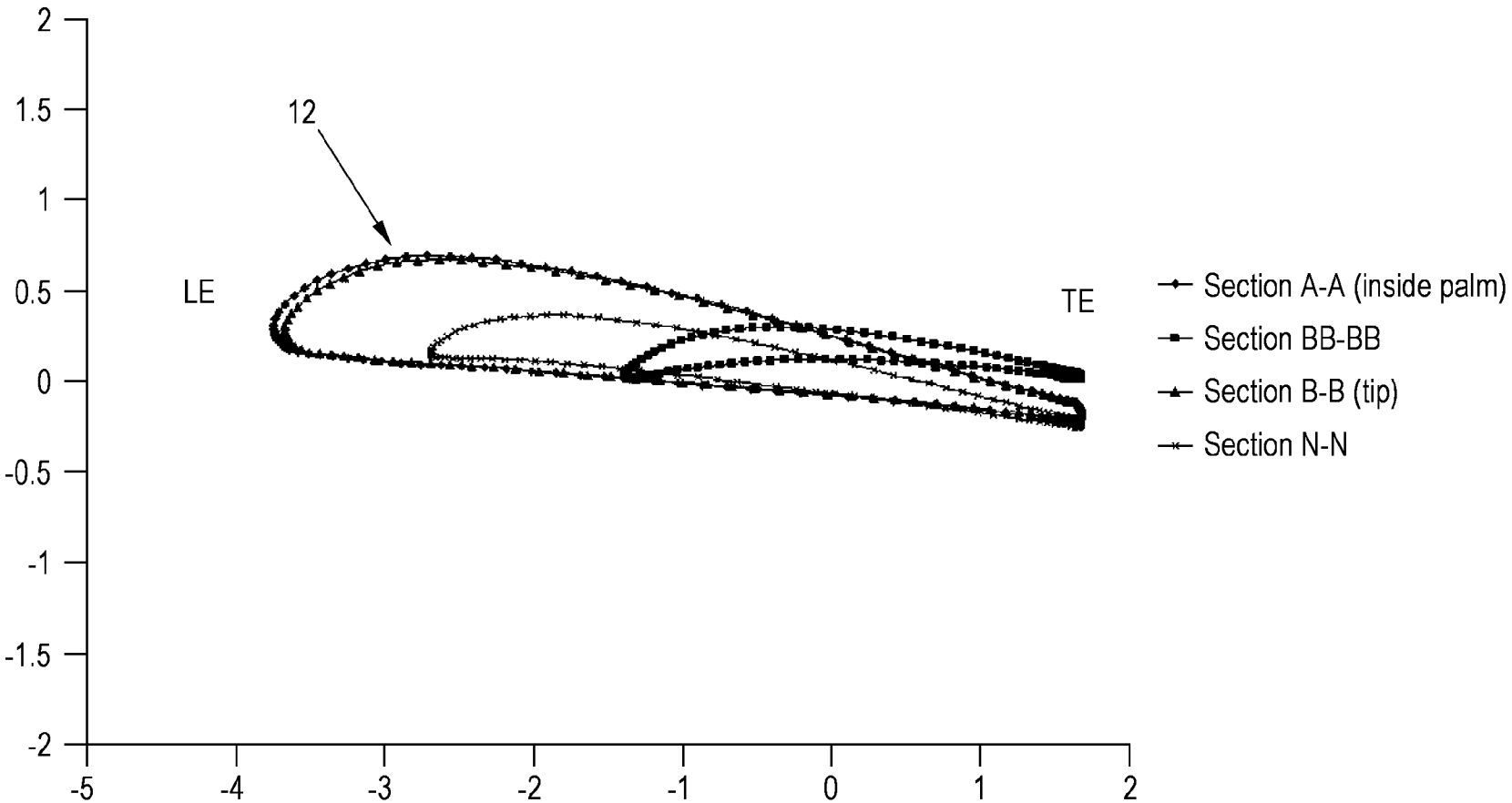
FIG. 8 is schematic illustration of the profile of an inlet guide vane according to an embodiment of the invention at points along its length.

As can particularly be seen in FIGS. 5 and 6, each IGV 10 is an airfoil 11 with a varying profile 12. At the top, the airfoil 11 is thicker and longer than it is at the bottom, and the angle of attack changes along the length of the IGV 10. FIG. 8 shows the profile of an IGV of an embodiment as it appears at specific cross sections A-A, B-B, N-N, and BB-BB of the IGV 10 as seen in FIG. 7.

To define the airfoil shape or profile 12 of the IGV 10, a unique set of points in space were derived by analytical means, such as by iteration of mechanical and aerodynamic loadings and flow conditions in a modeling computer software application. More specifically, to define the airfoil profiles 12 of the IGV 10, a unique set of points in space were derived using modeling computer software at respective spanwise positions on the blade. Local inflow distortions at each spanwise position were considered and each profile was derived with the goals of minimizing total pressure drop, broadening the separation-free range of operation vs. angle of attack to match the predicted inflow distortion, and satisfying mechanical requirements for strength, vibrational stress, and ease of manufacture. The profiles are interpolated to define the entire blade surface. This process is carried out in a computer software environment, such as a proprietary computer software environment. Fully three-dimensional computer analyses and scale model testing of the combined IGV and engine inlet were conducted to validate the design. The unique set of points is described using the Cartesian coordinate system of three mutually perpendicular axes x, y, and z. An example unique set of points is set forth in TABLE 1 below and is sufficient to enable manufacture of the IGV 10, such as with a "CNC" machine or other suitable apparatus, or by another method, such as casting, for example. Producing an IGV following the unique set of points yields an IGV that drives the initiation of flow separation from the IGVs to lower flow conditions than previous IGVs. As a result, vibration resulting from flow separation is significantly reduced, increasing reliability and reducing vibration-induced stresses on the IGVs and other components of the gas turbine.

The Cartesian coordinate system used to describe the unique set of points is oriented so that each subset of the unique set of points defines a planar section starting from the blade outer diameter (section A-A just inside blade "palm") to the blade inner diameter (section BB-BB). FIG. 8 shows the subsets of section A-A, section B-B, section N-N, and section BB-BB for exemplary purposes. As shown in FIG. 7, section A-A is at the top of the blade, and the x- and y-axes lie in the plane of section A-A with the origin located at the longitudinal axis z of the top shaft portion, which is also the axis of rotation of the entire IGV 10. The axes are also shown in FIGS. 3-6. Positive x values are toward the trailing edge of the blade, and positive y values are toward the tops of the profiles as seen in FIG. 6. The z-axis is the "stacking axis" (normal to the planes of the sections) and extends along the axis of rotation of the IGV, and positive values are toward the bottom of the blade at which section BB-BB is located. The units in which the unique set of points is expressed are inches, but other units could be used so long as the values are converted appropriately.

By defining x and y coordinate values at selected locations in a z direction normal to the x-y plane and connecting the x-y points with smooth curves, the profile section of the blade at each z distance along the length of the blade can be defined. By connecting each section with smooth surfaces, the entire blade is described and can be formed. It should be noted that the values in TABLE 1 are for non-operational, ambient conditions of the bare material of the blade.

The table values are generated and shown to three decimal places in the x-y plane of each section and three decimal places along the z-axis. Manufacturing tolerances and coatings that might be applied should be taken into account for the actual profile of the airfoil. For example, each coordinate value should be read as including typical manufacturing tolerances, such as ±0.16 inches for example, though other tolerances can be employed as appropriate for particular applications, all in accordance with an embodiment of the invention. Thus, any value in the table defines a range of variation between the ideal points represented in the table and measured points on the actual finished airfoil surface at ambient conditions. The IGV airfoil design of embodiments is not impaired in its performance as a result of these variations. While embodiments of the invention are described having numerical values with a three decimal place accuracy and having particular manufacturing tolerances, it will be appreciated that this is for discussion purposes only and that the scope of the invention is not so limited. As such, it will be appreciated that the scope of the invention also includes other numerical values having less than or greater than a three decimal place accuracy, and other types and values of manufacturing tolerances.

The particular values given in TABLE 1 can be scaled up or down to yield a different sized IGV. In such instances, a scaling factor can be applied to all values such that the IGV remains substantially identical in its proportions, but is larger or smaller in accordance with the scaling factor. The values in TABLE 1, for example, have a scaling factor of 1.

The coordinate values given in TABLE 1 below provide the nominal profile envelope for an exemplary inlet guide vane according to an embodiment.

TABLE 1

| X | Y | Z |
|---|---|---|
| Section A-A | | |
| −3.735 | 0.258 | −0.605 |
| −3.736 | 0.260 | −0.605 |
| −3.738 | 0.264 | −0.605 |
| −3.740 | 0.273 | −0.605 |
| −3.743 | 0.288 | −0.605 |
| −3.744 | 0.314 | −0.605 |
| −3.736 | 0.348 | −0.605 |
| −3.710 | 0.386 | −0.605 |
| −3.669 | 0.427 | −0.605 |
| −3.609 | 0.472 | −0.605 |
| −3.535 | 0.517 | −0.605 |
| −3.453 | 0.558 | −0.605 |
| −3.357 | 0.594 | −0.605 |
| −3.246 | 0.627 | −0.605 |
| −3.122 | 0.655 | −0.605 |
| −2.991 | 0.675 | −0.605 |
| −2.854 | 0.689 | −0.605 |
| −2.712 | 0.694 | −0.605 |
| −2.564 | 0.691 | −0.605 |
| −2.411 | 0.683 | −0.605 |
| −2.251 | 0.670 | −0.605 |

TABLE 1-continued

| X | Y | Z |
|---|---|---|
| −2.087 | 0.654 | −0.605 |
| −1.916 | 0.633 | −0.605 |
| −1.746 | 0.609 | −0.605 |
| −1.577 | 0.583 | −0.605 |
| −1.408 | 0.554 | −0.605 |
| −1.239 | 0.524 | −0.605 |
| −1.070 | 0.492 | −0.605 |
| −0.902 | 0.458 | −0.605 |
| −0.734 | 0.423 | −0.605 |
| −0.567 | 0.387 | −0.605 |
| −0.399 | 0.350 | −0.605 |
| −0.232 | 0.312 | −0.605 |
| −0.065 | 0.273 | −0.605 |
| 0.097 | 0.235 | −0.605 |
| 0.252 | 0.199 | −0.605 |
| 0.403 | 0.163 | −0.605 |
| 0.547 | 0.129 | −0.605 |
| 0.687 | 0.097 | −0.605 |
| 0.820 | 0.066 | −0.605 |
| 0.949 | 0.036 | −0.605 |
| 1.066 | 0.010 | −0.605 |
| 1.172 | −0.014 | −0.605 |
| 1.267 | −0.034 | −0.605 |
| 1.351 | −0.052 | −0.605 |
| 1.423 | −0.067 | −0.605 |
| 1.485 | −0.079 | −0.605 |
| 1.538 | −0.090 | −0.605 |
| 1.582 | −0.098 | −0.605 |
| 1.619 | −0.105 | −0.605 |
| 1.648 | −0.112 | −0.605 |
| 1.666 | −0.126 | −0.605 |
| 1.675 | −0.140 | −0.605 |
| 1.680 | −0.153 | −0.605 |
| 1.681 | −0.165 | −0.605 |
| 1.680 | −0.173 | −0.605 |
| 1.678 | −0.181 | −0.605 |
| 1.674 | −0.191 | −0.605 |
| 1.666 | −0.203 | −0.605 |
| 1.653 | −0.213 | −0.605 |
| 1.633 | −0.221 | −0.605 |
| 1.605 | −0.219 | −0.605 |
| 1.569 | −0.215 | −0.605 |
| 1.526 | −0.209 | −0.605 |
| 1.475 | −0.202 | −0.605 |
| 1.415 | −0.195 | −0.605 |
| 1.344 | −0.186 | −0.605 |
| 1.262 | −0.178 | −0.605 |
| 1.170 | −0.168 | −0.605 |
| 1.066 | −0.158 | −0.605 |
| 0.951 | −0.148 | −0.605 |
| 0.825 | −0.137 | −0.605 |
| 0.694 | −0.126 | −0.605 |
| 0.557 | −0.116 | −0.605 |
| 0.415 | −0.105 | −0.605 |
| 0.267 | −0.095 | −0.605 |
| 0.113 | −0.084 | −0.605 |
| −0.046 | −0.073 | −0.605 |
| −0.210 | −0.062 | −0.605 |
| −0.374 | −0.051 | −0.605 |
| −0.539 | −0.040 | −0.605 |
| −0.703 | −0.029 | −0.605 |
| −0.867 | −0.018 | −0.605 |
| −1.032 | −0.007 | −0.605 |
| −1.196 | 0.004 | −0.605 |
| −1.360 | 0.015 | −0.605 |
| −1.525 | 0.026 | −0.605 |
| −1.689 | 0.037 | −0.605 |
| −1.853 | 0.048 | −0.605 |
| −2.018 | 0.058 | −0.605 |
| −2.177 | 0.068 | −0.605 |
| −2.330 | 0.076 | −0.605 |
| −2.478 | 0.084 | −0.605 |
| −2.621 | 0.089 | −0.605 |
| −2.758 | 0.095 | −0.605 |
| −2.889 | 0.102 | −0.605 |
| −3.015 | 0.111 | −0.605 |
| −3.136 | 0.120 | −0.605 |
| −3.245 | 0.130 | −0.605 |

TABLE 1-continued

| X | Y | Z |
|---|---|---|
| −3.344 | 0.138 | −0.605 |
| −3.431 | 0.147 | −0.605 |
| −3.513 | 0.155 | −0.605 |
| −3.584 | 0.164 | −0.605 |
| −3.638 | 0.175 | −0.605 |
| −3.679 | 0.191 | −0.605 |
| −3.705 | 0.211 | −0.605 |
| −3.721 | 0.230 | −0.605 |
| −3.728 | 0.242 | −0.605 |
| −3.732 | 0.249 | −0.605 |
| −3.734 | 0.253 | −0.605 |
| −3.735 | 0.255 | −0.605 |
| −3.735 | 0.257 | −0.605 |
| Section B-B | | |
| −3.658 | 0.250 | 0.000 |
| −3.659 | 0.252 | 0.000 |
| −3.660 | 0.257 | 0.000 |
| −3.663 | 0.266 | 0.000 |
| −3.665 | 0.280 | 0.000 |
| −3.664 | 0.306 | 0.000 |
| −3.652 | 0.338 | 0.000 |
| −3.624 | 0.375 | 0.000 |
| −3.583 | 0.415 | 0.000 |
| −3.522 | 0.459 | 0.000 |
| −3.448 | 0.503 | 0.000 |
| −3.367 | 0.542 | 0.000 |
| −3.272 | 0.577 | 0.000 |
| −3.163 | 0.609 | 0.000 |
| −3.041 | 0.636 | 0.000 |
| −2.912 | 0.656 | 0.000 |
| −2.776 | 0.669 | 0.000 |
| −2.633 | 0.673 | 0.000 |
| −2.486 | 0.670 | 0.000 |
| −2.334 | 0.662 | 0.000 |
| −2.177 | 0.649 | 0.000 |
| −2.016 | 0.632 | 0.000 |
| −1.849 | 0.612 | 0.000 |
| −1.682 | 0.588 | 0.000 |
| −1.516 | 0.563 | 0.000 |
| −1.351 | 0.534 | 0.000 |
| −1.185 | 0.505 | 0.000 |
| −1.021 | 0.473 | 0.000 |
| −0.856 | 0.440 | 0.000 |
| −0.691 | 0.406 | 0.000 |
| −0.527 | 0.370 | 0.000 |
| −0.363 | 0.334 | 0.000 |
| −0.199 | 0.297 | 0.000 |
| −0.035 | 0.259 | 0.000 |
| 0.124 | 0.222 | 0.000 |
| 0.276 | 0.186 | 0.000 |
| 0.424 | 0.152 | 0.000 |
| 0.566 | 0.118 | 0.000 |
| 0.702 | 0.087 | 0.000 |
| 0.833 | 0.056 | 0.000 |
| 0.959 | 0.027 | 0.000 |
| 1.074 | 0.001 | 0.000 |
| 1.178 | −0.022 | 0.000 |
| 1.271 | −0.042 | 0.000 |
| 1.354 | −0.059 | 0.000 |
| 1.425 | −0.074 | 0.000 |
| 1.486 | −0.086 | 0.000 |
| 1.537 | −0.096 | 0.000 |
| 1.581 | −0.104 | 0.000 |
| 1.617 | −0.111 | 0.000 |
| 1.645 | −0.117 | 0.000 |
| 1.664 | −0.128 | 0.000 |
| 1.675 | −0.142 | 0.000 |
| 1.679 | −0.155 | 0.000 |
| 1.681 | −0.166 | 0.000 |
| 1.680 | −0.174 | 0.000 |
| 1.678 | −0.182 | 0.000 |
| 1.674 | −0.192 | 0.000 |
| 1.666 | −0.202 | 0.000 |
| 1.653 | −0.212 | 0.000 |
| 1.632 | −0.218 | 0.000 |
| 1.604 | −0.215 | 0.000 |
| 1.569 | −0.210 | 0.000 |

TABLE 1-continued

| X | Y | Z |
|---|---|---|
| 1.527 | −0.204 | 0.000 |
| 1.476 | −0.198 | 0.000 |
| 1.417 | −0.191 | 0.000 |
| 1.348 | −0.183 | 0.000 |
| 1.267 | −0.174 | 0.000 |
| 1.176 | −0.164 | 0.000 |
| 1.073 | −0.155 | 0.000 |
| 0.960 | −0.144 | 0.000 |
| 0.837 | −0.134 | 0.000 |
| 0.707 | −0.123 | 0.000 |
| 0.573 | −0.113 | 0.000 |
| 0.432 | −0.102 | 0.000 |
| 0.287 | −0.092 | 0.000 |
| 0.136 | −0.081 | 0.000 |
| −0.020 | −0.070 | 0.000 |
| −0.182 | −0.059 | 0.000 |
| −0.344 | −0.048 | 0.000 |
| −0.506 | −0.038 | 0.000 |
| −0.668 | −0.027 | 0.000 |
| −0.829 | −0.016 | 0.000 |
| −0.991 | −0.005 | 0.000 |
| −1.153 | 0.006 | 0.000 |
| −1.315 | 0.017 | 0.000 |
| −1.477 | 0.028 | 0.000 |
| −1.638 | 0.039 | 0.000 |
| −1.800 | 0.050 | 0.000 |
| −1.962 | 0.060 | 0.000 |
| −2.118 | 0.070 | 0.000 |
| −2.269 | 0.078 | 0.000 |
| −2.415 | 0.085 | 0.000 |
| −2.556 | 0.091 | 0.000 |
| −2.691 | 0.097 | 0.000 |
| −2.820 | 0.105 | 0.000 |
| −2.944 | 0.113 | 0.000 |
| −3.063 | 0.123 | 0.000 |
| −3.170 | 0.132 | 0.000 |
| −3.267 | 0.140 | 0.000 |
| −3.353 | 0.149 | 0.000 |
| −3.434 | 0.157 | 0.000 |
| −3.504 | 0.165 | 0.000 |
| −3.557 | 0.175 | 0.000 |
| −3.598 | 0.188 | 0.000 |
| −3.626 | 0.205 | 0.000 |
| −3.643 | 0.223 | 0.000 |
| −3.650 | 0.234 | 0.000 |
| −3.654 | 0.242 | 0.000 |
| −3.656 | 0.246 | 0.000 |
| −3.657 | 0.248 | 0.000 |
| −3.658 | 0.249 | 0.000 |
| Section C-C | | |
| −3.589 | 0.243 | 0.536 |
| −3.590 | 0.245 | 0.536 |
| −3.591 | 0.250 | 0.536 |
| −3.594 | 0.258 | 0.536 |
| −3.595 | 0.272 | 0.536 |
| −3.593 | 0.297 | 0.536 |
| −3.578 | 0.327 | 0.536 |
| −3.550 | 0.362 | 0.536 |
| −3.509 | 0.400 | 0.536 |
| −3.450 | 0.443 | 0.536 |
| −3.378 | 0.485 | 0.536 |
| −3.297 | 0.523 | 0.536 |
| −3.203 | 0.558 | 0.536 |
| −3.096 | 0.589 | 0.536 |
| −2.978 | 0.615 | 0.536 |
| −2.852 | 0.634 | 0.536 |
| −2.719 | 0.646 | 0.536 |
| −2.580 | 0.651 | 0.536 |
| −2.436 | 0.648 | 0.536 |
| −2.286 | 0.640 | 0.536 |
| −2.131 | 0.627 | 0.536 |
| −1.971 | 0.611 | 0.536 |
| −1.806 | 0.591 | 0.536 |
| −1.641 | 0.568 | 0.536 |
| −1.477 | 0.543 | 0.536 |
| −1.314 | 0.516 | 0.536 |
| −1.151 | 0.486 | 0.536 |

TABLE 1-continued

| X | Y | Z |
|---|---|---|
| −0.988 | 0.456 | 0.536 |
| −0.825 | 0.423 | 0.536 |
| −0.663 | 0.390 | 0.536 |
| −0.500 | 0.355 | 0.536 |
| −0.338 | 0.320 | 0.536 |
| −0.177 | 0.283 | 0.536 |
| −0.015 | 0.246 | 0.536 |
| 0.142 | 0.210 | 0.536 |
| 0.292 | 0.175 | 0.536 |
| 0.438 | 0.141 | 0.536 |
| 0.578 | 0.109 | 0.536 |
| 0.713 | 0.077 | 0.536 |
| 0.842 | 0.048 | 0.536 |
| 0.966 | 0.019 | 0.536 |
| 1.079 | −0.006 | 0.536 |
| 1.182 | −0.029 | 0.536 |
| 1.274 | −0.049 | 0.536 |
| 1.355 | −0.066 | 0.536 |
| 1.426 | −0.080 | 0.536 |
| 1.485 | −0.092 | 0.536 |
| 1.536 | −0.102 | 0.536 |
| 1.579 | −0.110 | 0.536 |
| 1.615 | −0.116 | 0.536 |
| 1.643 | −0.122 | 0.536 |
| 1.663 | −0.131 | 0.536 |
| 1.674 | −0.143 | 0.536 |
| 1.679 | −0.156 | 0.536 |
| 1.681 | −0.167 | 0.536 |
| 1.680 | −0.175 | 0.536 |
| 1.678 | −0.183 | 0.536 |
| 1.674 | −0.193 | 0.536 |
| 1.665 | −0.203 | 0.536 |
| 1.652 | −0.211 | 0.536 |
| 1.631 | −0.215 | 0.536 |
| 1.604 | −0.211 | 0.536 |
| 1.569 | −0.207 | 0.536 |
| 1.527 | −0.201 | 0.536 |
| 1.478 | −0.195 | 0.536 |
| 1.420 | −0.187 | 0.536 |
| 1.351 | −0.179 | 0.536 |
| 1.271 | −0.171 | 0.536 |
| 1.181 | −0.161 | 0.536 |
| 1.080 | −0.152 | 0.536 |
| 0.969 | −0.141 | 0.536 |
| 0.847 | −0.131 | 0.536 |
| 0.719 | −0.120 | 0.536 |
| 0.587 | −0.110 | 0.536 |
| 0.448 | −0.099 | 0.536 |
| 0.305 | −0.089 | 0.536 |
| 0.156 | −0.078 | 0.536 |
| 0.002 | −0.067 | 0.536 |
| −0.158 | −0.056 | 0.536 |
| −0.317 | −0.045 | 0.536 |
| −0.477 | −0.034 | 0.536 |
| −0.636 | −0.023 | 0.536 |
| −0.796 | −0.012 | 0.536 |
| −0.955 | −0.001 | 0.536 |
| −1.115 | 0.010 | 0.536 |
| −1.274 | 0.022 | 0.536 |
| −1.434 | 0.033 | 0.536 |
| −1.593 | 0.044 | 0.536 |
| −1.753 | 0.055 | 0.536 |
| −1.912 | 0.065 | 0.536 |
| −2.066 | 0.075 | 0.536 |
| −2.215 | 0.083 | 0.536 |
| −2.359 | 0.090 | 0.536 |
| −2.498 | 0.096 | 0.536 |
| −2.631 | 0.102 | 0.536 |
| −2.758 | 0.110 | 0.536 |
| −2.881 | 0.118 | 0.536 |
| −2.998 | 0.127 | 0.536 |
| −3.104 | 0.136 | 0.536 |
| −3.199 | 0.144 | 0.536 |
| −3.284 | 0.152 | 0.536 |
| −3.364 | 0.159 | 0.536 |
| −3.433 | 0.167 | 0.536 |
| −3.485 | 0.176 | 0.536 |
| −3.527 | 0.187 | 0.536 |

TABLE 1-continued

| X | Y | Z |
|---|---|---|
| −3.556 | 0.201 | 0.536 |
| −3.573 | 0.217 | 0.536 |
| −3.581 | 0.228 | 0.536 |
| −3.586 | 0.235 | 0.536 |
| −3.587 | 0.239 | 0.536 |
| −3.588 | 0.241 | 0.536 |
| −3.589 | 0.242 | 0.536 |
| Section D-D | | |
| −3.520 | 0.237 | 1.072 |
| −3.521 | 0.239 | 1.072 |
| −3.522 | 0.243 | 1.072 |
| −3.524 | 0.252 | 1.072 |
| −3.525 | 0.265 | 1.072 |
| −3.519 | 0.289 | 1.072 |
| −3.502 | 0.318 | 1.072 |
| −3.473 | 0.350 | 1.072 |
| −3.431 | 0.386 | 1.072 |
| −3.372 | 0.426 | 1.072 |
| −3.299 | 0.466 | 1.072 |
| −3.219 | 0.501 | 1.072 |
| −3.125 | 0.533 | 1.072 |
| −3.021 | 0.561 | 1.072 |
| −2.904 | 0.585 | 1.072 |
| −2.781 | 0.602 | 1.072 |
| −2.652 | 0.613 | 1.072 |
| −2.517 | 0.617 | 1.072 |
| −2.376 | 0.614 | 1.072 |
| −2.228 | 0.605 | 1.072 |
| −2.076 | 0.593 | 1.072 |
| −1.919 | 0.577 | 1.072 |
| −1.757 | 0.558 | 1.072 |
| −1.595 | 0.536 | 1.072 |
| −1.433 | 0.511 | 1.072 |
| −1.272 | 0.485 | 1.072 |
| −1.111 | 0.457 | 1.072 |
| −0.950 | 0.427 | 1.072 |
| −0.790 | 0.396 | 1.072 |
| −0.630 | 0.364 | 1.072 |
| −0.470 | 0.331 | 1.072 |
| −0.311 | 0.297 | 1.072 |
| −0.151 | 0.262 | 1.072 |
| 0.008 | 0.226 | 1.072 |
| 0.162 | 0.192 | 1.072 |
| 0.311 | 0.158 | 1.072 |
| 0.454 | 0.125 | 1.072 |
| 0.592 | 0.094 | 1.072 |
| 0.725 | 0.064 | 1.072 |
| 0.852 | 0.035 | 1.072 |
| 0.974 | 0.008 | 1.072 |
| 1.086 | −0.016 | 1.072 |
| 1.187 | −0.038 | 1.072 |
| 1.278 | −0.058 | 1.072 |
| 1.358 | −0.074 | 1.072 |
| 1.427 | −0.088 | 1.072 |
| 1.486 | −0.099 | 1.072 |
| 1.536 | −0.109 | 1.072 |
| 1.578 | −0.117 | 1.072 |
| 1.613 | −0.123 | 1.072 |
| 1.641 | −0.129 | 1.072 |
| 1.661 | −0.136 | 1.072 |
| 1.673 | −0.147 | 1.072 |
| 1.679 | −0.159 | 1.072 |
| 1.681 | −0.170 | 1.072 |
| 1.680 | −0.178 | 1.072 |
| 1.678 | −0.186 | 1.072 |
| 1.673 | −0.196 | 1.072 |
| 1.664 | −0.205 | 1.072 |
| 1.650 | −0.212 | 1.072 |
| 1.629 | −0.213 | 1.072 |
| 1.602 | −0.210 | 1.072 |
| 1.568 | −0.205 | 1.072 |
| 1.527 | −0.199 | 1.072 |
| 1.478 | −0.193 | 1.072 |
| 1.421 | −0.186 | 1.072 |
| 1.353 | −0.178 | 1.072 |
| 1.274 | −0.169 | 1.072 |
| 1.186 | −0.160 | 1.072 |

TABLE 1-continued

| X | Y | Z |
|---|---|---|
| 1.086 | −0.150 | 1.072 |
| 0.976 | −0.139 | 1.072 |
| 0.856 | −0.128 | 1.072 |
| 0.730 | −0.117 | 1.072 |
| 0.600 | −0.106 | 1.072 |
| 0.463 | −0.095 | 1.072 |
| 0.322 | −0.084 | 1.072 |
| 0.175 | −0.073 | 1.072 |
| 0.023 | −0.061 | 1.072 |
| −0.134 | −0.049 | 1.072 |
| −0.291 | −0.037 | 1.072 |
| −0.448 | −0.025 | 1.072 |
| −0.605 | −0.014 | 1.072 |
| −0.762 | −0.002 | 1.072 |
| −0.920 | 0.010 | 1.072 |
| −1.077 | 0.022 | 1.072 |
| −1.234 | 0.033 | 1.072 |
| −1.391 | 0.045 | 1.072 |
| −1.548 | 0.057 | 1.072 |
| −1.705 | 0.068 | 1.072 |
| −1.863 | 0.079 | 1.072 |
| −2.015 | 0.089 | 1.072 |
| −2.162 | 0.098 | 1.072 |
| −2.303 | 0.105 | 1.072 |
| −2.440 | 0.111 | 1.072 |
| −2.571 | 0.117 | 1.072 |
| −2.697 | 0.124 | 1.072 |
| −2.817 | 0.132 | 1.072 |
| −2.933 | 0.140 | 1.072 |
| −3.038 | 0.147 | 1.072 |
| −3.132 | 0.154 | 1.072 |
| −3.216 | 0.159 | 1.072 |
| −3.294 | 0.165 | 1.072 |
| −3.362 | 0.171 | 1.072 |
| −3.414 | 0.177 | 1.072 |
| −3.456 | 0.186 | 1.072 |
| −3.485 | 0.197 | 1.072 |
| −3.504 | 0.211 | 1.072 |
| −3.512 | 0.222 | 1.072 |
| −3.517 | 0.229 | 1.072 |
| −3.519 | 0.233 | 1.072 |
| −3.519 | 0.235 | 1.072 |
| −3.520 | 0.236 | 1.072 |
| | Section E-E | |
| −3.451 | 0.230 | 1.607 |
| −3.452 | 0.232 | 1.607 |
| −3.453 | 0.236 | 1.607 |
| −3.454 | 0.245 | 1.607 |
| −3.454 | 0.258 | 1.607 |
| −3.446 | 0.281 | 1.607 |
| −3.428 | 0.308 | 1.607 |
| −3.397 | 0.338 | 1.607 |
| −3.354 | 0.371 | 1.607 |
| −3.295 | 0.409 | 1.607 |
| −3.223 | 0.445 | 1.607 |
| −3.143 | 0.477 | 1.607 |
| −3.052 | 0.507 | 1.607 |
| −2.948 | 0.533 | 1.607 |
| −2.831 | 0.554 | 1.607 |
| −2.709 | 0.570 | 1.607 |
| −2.580 | 0.579 | 1.607 |
| −2.447 | 0.582 | 1.607 |
| −2.308 | 0.578 | 1.607 |
| −2.164 | 0.569 | 1.607 |
| −2.015 | 0.557 | 1.607 |
| −1.861 | 0.542 | 1.607 |
| −1.702 | 0.523 | 1.607 |
| −1.543 | 0.501 | 1.607 |
| −1.384 | 0.478 | 1.607 |
| −1.226 | 0.452 | 1.607 |
| −1.067 | 0.425 | 1.607 |
| −0.910 | 0.397 | 1.607 |
| −0.752 | 0.367 | 1.607 |
| −0.594 | 0.336 | 1.607 |
| −0.437 | 0.304 | 1.607 |
| −0.280 | 0.271 | 1.607 |
| −0.123 | 0.238 | 1.607 |

TABLE 1-continued

| X | Y | Z |
|---|---|---|
| 0.034 | 0.204 | 1.607 |
| 0.185 | 0.171 | 1.607 |
| 0.331 | 0.139 | 1.607 |
| 0.472 | 0.108 | 1.607 |
| 0.608 | 0.078 | 1.607 |
| 0.739 | 0.049 | 1.607 |
| 0.864 | 0.021 | 1.607 |
| 0.984 | −0.005 | 1.607 |
| 1.094 | −0.028 | 1.607 |
| 1.193 | −0.049 | 1.607 |
| 1.282 | −0.068 | 1.607 |
| 1.361 | −0.084 | 1.607 |
| 1.429 | −0.097 | 1.607 |
| 1.487 | −0.109 | 1.607 |
| 1.536 | −0.118 | 1.607 |
| 1.578 | −0.126 | 1.607 |
| 1.612 | −0.132 | 1.607 |
| 1.639 | −0.137 | 1.607 |
| 1.660 | −0.143 | 1.607 |
| 1.672 | −0.153 | 1.607 |
| 1.679 | −0.165 | 1.607 |
| 1.680 | −0.175 | 1.607 |
| 1.680 | −0.183 | 1.607 |
| 1.678 | −0.191 | 1.607 |
| 1.673 | −0.200 | 1.607 |
| 1.664 | −0.209 | 1.607 |
| 1.650 | −0.215 | 1.607 |
| 1.629 | −0.215 | 1.607 |
| 1.602 | −0.211 | 1.607 |
| 1.569 | −0.207 | 1.607 |
| 1.528 | −0.201 | 1.607 |
| 1.480 | −0.195 | 1.607 |
| 1.424 | −0.188 | 1.607 |
| 1.357 | −0.179 | 1.607 |
| 1.279 | −0.170 | 1.607 |
| 1.192 | −0.161 | 1.607 |
| 1.094 | −0.151 | 1.607 |
| 0.986 | −0.140 | 1.607 |
| 0.867 | −0.128 | 1.607 |
| 0.743 | −0.117 | 1.607 |
| 0.614 | −0.105 | 1.607 |
| 0.480 | −0.094 | 1.607 |
| 0.341 | −0.082 | 1.607 |
| 0.196 | −0.070 | 1.607 |
| 0.046 | −0.057 | 1.607 |
| −0.109 | −0.045 | 1.607 |
| −0.264 | −0.032 | 1.607 |
| −0.418 | −0.020 | 1.607 |
| −0.573 | −0.007 | 1.607 |
| −0.728 | 0.005 | 1.607 |
| −0.883 | 0.018 | 1.607 |
| −1.038 | 0.030 | 1.607 |
| −1.193 | 0.043 | 1.607 |
| −1.348 | 0.055 | 1.607 |
| −1.503 | 0.067 | 1.607 |
| −1.658 | 0.079 | 1.607 |
| −1.813 | 0.090 | 1.607 |
| −1.963 | 0.101 | 1.607 |
| −2.108 | 0.110 | 1.607 |
| −2.248 | 0.117 | 1.607 |
| −2.382 | 0.123 | 1.607 |
| −2.512 | 0.129 | 1.607 |
| −2.636 | 0.136 | 1.607 |
| −2.755 | 0.143 | 1.607 |
| −2.868 | 0.150 | 1.607 |
| −2.972 | 0.156 | 1.607 |
| −3.065 | 0.161 | 1.607 |
| −3.148 | 0.166 | 1.607 |
| −3.225 | 0.169 | 1.607 |
| −3.293 | 0.173 | 1.607 |
| −3.344 | 0.178 | 1.607 |
| −3.385 | 0.185 | 1.607 |
| −3.415 | 0.193 | 1.607 |
| −3.435 | 0.206 | 1.607 |
| −3.443 | 0.215 | 1.607 |
| −3.448 | 0.222 | 1.607 |
| −3.450 | 0.226 | 1.607 |
| −3.450 | 0.228 | 1.607 |

TABLE 1-continued

| X | Y | Z |
|---|---|---|
| −3.451 | 0.229 | 1.607 |
| | Section F-F | |
| −3.382 | 0.223 | 2.143 |
| −3.383 | 0.225 | 2.143 |
| −3.384 | 0.230 | 2.143 |
| −3.384 | 0.238 | 2.143 |
| −3.383 | 0.251 | 2.143 |
| −3.374 | 0.273 | 2.143 |
| −3.354 | 0.298 | 2.143 |
| −3.323 | 0.326 | 2.143 |
| −3.280 | 0.357 | 2.143 |
| −3.220 | 0.392 | 2.143 |
| −3.149 | 0.426 | 2.143 |
| −3.070 | 0.456 | 2.143 |
| −2.978 | 0.483 | 2.143 |
| −2.876 | 0.507 | 2.143 |
| −2.762 | 0.527 | 2.143 |
| −2.643 | 0.540 | 2.143 |
| −2.517 | 0.548 | 2.143 |
| −2.386 | 0.550 | 2.143 |
| −2.250 | 0.546 | 2.143 |
| −2.108 | 0.538 | 2.143 |
| −1.961 | 0.526 | 2.143 |
| −1.809 | 0.510 | 2.143 |
| −1.652 | 0.492 | 2.143 |
| −1.496 | 0.471 | 2.143 |
| −1.340 | 0.448 | 2.143 |
| −1.184 | 0.423 | 2.143 |
| −1.028 | 0.397 | 2.143 |
| −0.872 | 0.369 | 2.143 |
| −0.717 | 0.341 | 2.143 |
| −0.562 | 0.311 | 2.143 |
| −0.407 | 0.280 | 2.143 |
| −0.252 | 0.249 | 2.143 |
| −0.098 | 0.216 | 2.143 |
| 0.057 | 0.184 | 2.143 |
| 0.206 | 0.152 | 2.143 |
| 0.350 | 0.121 | 2.143 |
| 0.489 | 0.091 | 2.143 |
| 0.623 | 0.062 | 2.143 |
| 0.751 | 0.034 | 2.143 |
| 0.875 | 0.007 | 2.143 |
| 0.993 | −0.018 | 2.143 |
| 1.101 | −0.041 | 2.143 |
| 1.199 | −0.061 | 2.143 |
| 1.287 | −0.079 | 2.143 |
| 1.364 | −0.094 | 2.143 |
| 1.432 | −0.108 | 2.143 |
| 1.488 | −0.118 | 2.143 |
| 1.537 | −0.127 | 2.143 |
| 1.578 | −0.135 | 2.143 |
| 1.612 | −0.141 | 2.143 |
| 1.639 | −0.146 | 2.143 |
| 1.659 | −0.151 | 2.143 |
| 1.672 | −0.160 | 2.143 |
| 1.678 | −0.172 | 2.143 |
| 1.680 | −0.182 | 2.143 |
| 1.680 | −0.190 | 2.143 |
| 1.678 | −0.197 | 2.143 |
| 1.673 | −0.207 | 2.143 |
| 1.663 | −0.215 | 2.143 |
| 1.648 | −0.220 | 2.143 |
| 1.628 | −0.219 | 2.143 |
| 1.602 | −0.215 | 2.143 |
| 1.569 | −0.211 | 2.143 |
| 1.529 | −0.205 | 2.143 |
| 1.481 | −0.199 | 2.143 |
| 1.426 | −0.191 | 2.143 |
| 1.360 | −0.183 | 2.143 |
| 1.284 | −0.174 | 2.143 |
| 1.197 | −0.165 | 2.143 |
| 1.101 | −0.154 | 2.143 |
| 0.994 | −0.143 | 2.143 |
| 0.877 | −0.131 | 2.143 |
| 0.755 | −0.120 | 2.143 |
| 0.628 | −0.108 | 2.143 |
| 0.496 | −0.096 | 2.143 |

TABLE 1-continued

| X | Y | Z |
|---|---|---|
| 0.358 | −0.083 | 2.143 |
| 0.216 | −0.071 | 2.143 |
| 0.068 | −0.058 | 2.143 |
| −0.084 | −0.044 | 2.143 |
| −0.237 | −0.031 | 2.143 |
| −0.390 | −0.018 | 2.143 |
| −0.542 | −0.005 | 2.143 |
| −0.695 | 0.008 | 2.143 |
| −0.848 | 0.021 | 2.143 |
| −1.001 | 0.034 | 2.143 |
| −1.153 | 0.047 | 2.143 |
| −1.306 | 0.059 | 2.143 |
| −1.459 | 0.072 | 2.143 |
| −1.612 | 0.084 | 2.143 |
| −1.764 | 0.096 | 2.143 |
| −1.912 | 0.106 | 2.143 |
| −2.055 | 0.116 | 2.143 |
| −2.193 | 0.124 | 2.143 |
| −2.325 | 0.130 | 2.143 |
| −2.453 | 0.136 | 2.143 |
| −2.575 | 0.143 | 2.143 |
| −2.693 | 0.149 | 2.143 |
| −2.805 | 0.155 | 2.143 |
| −2.907 | 0.161 | 2.143 |
| −2.999 | 0.165 | 2.143 |
| −3.080 | 0.168 | 2.143 |
| −3.157 | 0.171 | 2.143 |
| −3.223 | 0.174 | 2.143 |
| −3.274 | 0.177 | 2.143 |
| −3.315 | 0.182 | 2.143 |
| −3.345 | 0.189 | 2.143 |
| −3.365 | 0.200 | 2.143 |
| −3.374 | 0.209 | 2.143 |
| −3.379 | 0.216 | 2.143 |
| −3.380 | 0.219 | 2.143 |
| −3.381 | 0.221 | 2.143 |
| −3.382 | 0.222 | 2.143 |
| | Section G-G | |
| −3.313 | 0.217 | 2.679 |
| −3.313 | 0.219 | 2.679 |
| −3.314 | 0.223 | 2.679 |
| −3.315 | 0.231 | 2.679 |
| −3.312 | 0.244 | 2.679 |
| −3.302 | 0.265 | 2.679 |
| −3.281 | 0.289 | 2.679 |
| −3.248 | 0.316 | 2.679 |
| −3.204 | 0.346 | 2.679 |
| −3.144 | 0.378 | 2.679 |
| −3.072 | 0.411 | 2.679 |
| −2.992 | 0.439 | 2.679 |
| −2.900 | 0.464 | 2.679 |
| −2.797 | 0.486 | 2.679 |
| −2.683 | 0.503 | 2.679 |
| −2.564 | 0.515 | 2.679 |
| −2.440 | 0.522 | 2.679 |
| −2.311 | 0.522 | 2.679 |
| −2.177 | 0.517 | 2.679 |
| −2.039 | 0.509 | 2.679 |
| −1.895 | 0.496 | 2.679 |
| −1.747 | 0.481 | 2.679 |
| −1.593 | 0.463 | 2.679 |
| −1.440 | 0.442 | 2.679 |
| −1.287 | 0.420 | 2.679 |
| −1.134 | 0.396 | 2.679 |
| −0.981 | 0.370 | 2.679 |
| −0.828 | 0.343 | 2.679 |
| −0.676 | 0.315 | 2.679 |
| −0.523 | 0.287 | 2.679 |
| −0.371 | 0.257 | 2.679 |
| −0.219 | 0.226 | 2.679 |
| −0.067 | 0.195 | 2.679 |
| 0.084 | 0.164 | 2.679 |
| 0.231 | 0.133 | 2.679 |
| 0.373 | 0.103 | 2.679 |
| 0.509 | 0.074 | 2.679 |
| 0.640 | 0.046 | 2.679 |
| 0.767 | 0.019 | 2.679 |

TABLE 1-continued

| X | Y | Z |
|---|---|---|
| 0.888 | −0.006 | 2.679 |
| 1.004 | −0.031 | 2.679 |
| 1.111 | −0.053 | 2.679 |
| 1.207 | −0.073 | 2.679 |
| 1.293 | −0.090 | 2.679 |
| 1.369 | −0.105 | 2.679 |
| 1.435 | −0.118 | 2.679 |
| 1.491 | −0.128 | 2.679 |
| 1.539 | −0.137 | 2.679 |
| 1.579 | −0.144 | 2.679 |
| 1.612 | −0.150 | 2.679 |
| 1.638 | −0.155 | 2.679 |
| 1.659 | −0.160 | 2.679 |
| 1.671 | −0.168 | 2.679 |
| 1.678 | −0.179 | 2.679 |
| 1.680 | −0.189 | 2.679 |
| 1.680 | −0.197 | 2.679 |
| 1.678 | −0.204 | 2.679 |
| 1.673 | −0.213 | 2.679 |
| 1.664 | −0.221 | 2.679 |
| 1.649 | −0.226 | 2.679 |
| 1.629 | −0.224 | 2.679 |
| 1.603 | −0.220 | 2.679 |
| 1.571 | −0.216 | 2.679 |
| 1.531 | −0.210 | 2.679 |
| 1.485 | −0.204 | 2.679 |
| 1.430 | −0.197 | 2.679 |
| 1.365 | −0.189 | 2.679 |
| 1.290 | −0.180 | 2.679 |
| 1.204 | −0.170 | 2.679 |
| 1.109 | −0.159 | 2.679 |
| 1.004 | −0.148 | 2.679 |
| 0.889 | −0.136 | 2.679 |
| 0.769 | −0.124 | 2.679 |
| 0.643 | −0.112 | 2.679 |
| 0.513 | −0.100 | 2.679 |
| 0.377 | −0.087 | 2.679 |
| 0.237 | −0.074 | 2.679 |
| 0.091 | −0.061 | 2.679 |
| −0.059 | −0.047 | 2.679 |
| −0.210 | −0.033 | 2.679 |
| −0.360 | −0.020 | 2.679 |
| −0.511 | −0.006 | 2.679 |
| −0.661 | 0.007 | 2.679 |
| −0.812 | 0.020 | 2.679 |
| −0.962 | 0.034 | 2.679 |
| −1.113 | 0.047 | 2.679 |
| −1.264 | 0.060 | 2.679 |
| −1.414 | 0.073 | 2.679 |
| −1.565 | 0.085 | 2.679 |
| −1.716 | 0.097 | 2.679 |
| −1.861 | 0.108 | 2.679 |
| −2.002 | 0.117 | 2.679 |
| −2.138 | 0.125 | 2.679 |
| −2.269 | 0.132 | 2.679 |
| −2.394 | 0.138 | 2.679 |
| −2.515 | 0.145 | 2.679 |
| −2.631 | 0.151 | 2.679 |
| −2.742 | 0.157 | 2.679 |
| −2.842 | 0.162 | 2.679 |
| −2.933 | 0.165 | 2.679 |
| −3.013 | 0.168 | 2.679 |
| −3.089 | 0.170 | 2.679 |
| −3.154 | 0.172 | 2.679 |
| −3.205 | 0.174 | 2.679 |
| −3.245 | 0.178 | 2.679 |
| −3.274 | 0.185 | 2.679 |
| −3.295 | 0.194 | 2.679 |
| −3.304 | 0.203 | 2.679 |
| −3.309 | 0.209 | 2.679 |
| −3.311 | 0.213 | 2.679 |
| −3.312 | 0.215 | 2.679 |
| −3.312 | 0.216 | 2.679 |
| | Section H-H | |
| −3.243 | 0.210 | 3.215 |
| −3.244 | 0.212 | 3.215 |
| −3.245 | 0.216 | 3.215 |

TABLE 1-continued

| X | Y | Z |
|---|---|---|
| −3.245 | 0.224 | 3.215 |
| −3.242 | 0.237 | 3.215 |
| −3.231 | 0.257 | 3.215 |
| −3.209 | 0.280 | 3.215 |
| −3.176 | 0.305 | 3.215 |
| −3.132 | 0.333 | 3.215 |
| −3.072 | 0.364 | 3.215 |
| −3.001 | 0.394 | 3.215 |
| −2.923 | 0.421 | 3.215 |
| −2.833 | 0.444 | 3.215 |
| −2.732 | 0.465 | 3.215 |
| −2.619 | 0.481 | 3.215 |
| −2.501 | 0.492 | 3.215 |
| −2.377 | 0.498 | 3.215 |
| −2.249 | 0.498 | 3.215 |
| −2.116 | 0.492 | 3.215 |
| −1.979 | 0.483 | 3.215 |
| −1.837 | 0.471 | 3.215 |
| −1.691 | 0.456 | 3.215 |
| −1.540 | 0.438 | 3.215 |
| −1.389 | 0.417 | 3.215 |
| −1.238 | 0.395 | 3.215 |
| −1.088 | 0.372 | 3.215 |
| −0.938 | 0.347 | 3.215 |
| −0.788 | 0.321 | 3.215 |
| −0.638 | 0.294 | 3.215 |
| −0.488 | 0.266 | 3.215 |
| −0.339 | 0.237 | 3.215 |
| −0.189 | 0.207 | 3.215 |
| −0.040 | 0.177 | 3.215 |
| 0.109 | 0.146 | 3.215 |
| 0.254 | 0.117 | 3.215 |
| 0.393 | 0.087 | 3.215 |
| 0.527 | 0.059 | 3.215 |
| 0.657 | 0.032 | 3.215 |
| 0.781 | 0.006 | 3.215 |
| 0.900 | −0.019 | 3.215 |
| 1.015 | −0.042 | 3.215 |
| 1.119 | −0.064 | 3.215 |
| 1.214 | −0.083 | 3.215 |
| 1.299 | −0.100 | 3.215 |
| 1.373 | −0.115 | 3.215 |
| 1.438 | −0.127 | 3.215 |
| 1.493 | −0.137 | 3.215 |
| 1.540 | −0.146 | 3.215 |
| 1.580 | −0.153 | 3.215 |
| 1.612 | −0.159 | 3.215 |
| 1.638 | −0.164 | 3.215 |
| 1.658 | −0.168 | 3.215 |
| 1.671 | −0.176 | 3.215 |
| 1.678 | −0.186 | 3.215 |
| 1.680 | −0.196 | 3.215 |
| 1.680 | −0.204 | 3.215 |
| 1.678 | −0.211 | 3.215 |
| 1.673 | −0.220 | 3.215 |
| 1.664 | −0.228 | 3.215 |
| 1.649 | −0.232 | 3.215 |
| 1.630 | −0.229 | 3.215 |
| 1.604 | −0.226 | 3.215 |
| 1.572 | −0.221 | 3.215 |
| 1.533 | −0.216 | 3.215 |
| 1.487 | −0.210 | 3.215 |
| 1.433 | −0.202 | 3.215 |
| 1.369 | −0.194 | 3.215 |
| 1.295 | −0.185 | 3.215 |
| 1.211 | −0.175 | 3.215 |
| 1.117 | −0.165 | 3.215 |
| 1.013 | −0.153 | 3.215 |
| 0.900 | −0.141 | 3.215 |
| 0.781 | −0.129 | 3.215 |
| 0.658 | −0.117 | 3.215 |
| 0.529 | −0.104 | 3.215 |
| 0.396 | −0.091 | 3.215 |
| 0.257 | −0.078 | 3.215 |
| 0.114 | −0.064 | 3.215 |
| −0.035 | −0.051 | 3.215 |
| −0.183 | −0.037 | 3.215 |
| −0.331 | −0.023 | 3.215 |

TABLE 1-continued

| X | Y | Z |
|---|---|---|
| −0.480 | −0.009 | 3.215 |
| −0.628 | 0.004 | 3.215 |
| −0.777 | 0.018 | 3.215 |
| −0.925 | 0.031 | 3.215 |
| −1.073 | 0.045 | 3.215 |
| −1.222 | 0.058 | 3.215 |
| −1.370 | 0.071 | 3.215 |
| −1.519 | 0.084 | 3.215 |
| −1.667 | 0.096 | 3.215 |
| −1.811 | 0.107 | 3.215 |
| −1.950 | 0.116 | 3.215 |
| −2.084 | 0.125 | 3.215 |
| −2.213 | 0.131 | 3.215 |
| −2.337 | 0.138 | 3.215 |
| −2.456 | 0.144 | 3.215 |
| −2.570 | 0.151 | 3.215 |
| −2.679 | 0.156 | 3.215 |
| −2.778 | 0.161 | 3.215 |
| −2.868 | 0.164 | 3.215 |
| −2.947 | 0.166 | 3.215 |
| −3.021 | 0.168 | 3.215 |
| −3.086 | 0.169 | 3.215 |
| −3.136 | 0.171 | 3.215 |
| −3.175 | 0.174 | 3.215 |
| −3.205 | 0.180 | 3.215 |
| −3.225 | 0.188 | 3.215 |
| −3.235 | 0.196 | 3.215 |
| −3.240 | 0.203 | 3.215 |
| −3.242 | 0.206 | 3.215 |
| −3.243 | 0.208 | 3.215 |
| −3.243 | 0.209 | 3.215 |
| | Section J-J | |
| −3.174 | 0.203 | 3.750 |
| −3.175 | 0.205 | 3.750 |
| −3.175 | 0.209 | 3.750 |
| −3.175 | 0.217 | 3.750 |
| −3.172 | 0.229 | 3.750 |
| −3.160 | 0.249 | 3.750 |
| −3.139 | 0.270 | 3.750 |
| −3.106 | 0.294 | 3.750 |
| −3.063 | 0.320 | 3.750 |
| −3.004 | 0.350 | 3.750 |
| −2.934 | 0.378 | 3.750 |
| −2.857 | 0.403 | 3.750 |
| −2.769 | 0.426 | 3.750 |
| −2.670 | 0.445 | 3.750 |
| −2.561 | 0.460 | 3.750 |
| −2.445 | 0.471 | 3.750 |
| −2.324 | 0.476 | 3.750 |
| −2.198 | 0.476 | 3.750 |
| −2.067 | 0.471 | 3.750 |
| −1.932 | 0.462 | 3.750 |
| −1.792 | 0.450 | 3.750 |
| −1.647 | 0.435 | 3.750 |
| −1.498 | 0.417 | 3.750 |
| −1.349 | 0.397 | 3.750 |
| −1.200 | 0.375 | 3.750 |
| −1.052 | 0.352 | 3.750 |
| −0.903 | 0.328 | 3.750 |
| −0.755 | 0.302 | 3.750 |
| −0.608 | 0.276 | 3.750 |
| −0.460 | 0.248 | 3.750 |
| −0.312 | 0.220 | 3.750 |
| −0.165 | 0.191 | 3.750 |
| −0.017 | 0.162 | 3.750 |
| 0.130 | 0.132 | 3.750 |
| 0.272 | 0.103 | 3.750 |
| 0.410 | 0.074 | 3.750 |
| 0.542 | 0.047 | 3.750 |
| 0.670 | 0.020 | 3.750 |
| 0.792 | −0.005 | 3.750 |
| 0.910 | −0.029 | 3.750 |
| 1.023 | −0.052 | 3.750 |
| 1.126 | −0.073 | 3.750 |
| 1.219 | −0.092 | 3.750 |
| 1.303 | −0.109 | 3.750 |
| 1.377 | −0.123 | 3.750 |

TABLE 1-continued

| X | Y | Z |
|---|---|---|
| 1.441 | −0.135 | 3.750 |
| 1.495 | −0.145 | 3.750 |
| 1.541 | −0.154 | 3.750 |
| 1.580 | −0.161 | 3.750 |
| 1.612 | −0.167 | 3.750 |
| 1.638 | −0.171 | 3.750 |
| 1.658 | −0.175 | 3.750 |
| 1.671 | −0.182 | 3.750 |
| 1.678 | −0.193 | 3.750 |
| 1.680 | −0.203 | 3.750 |
| 1.680 | −0.210 | 3.750 |
| 1.678 | −0.217 | 3.750 |
| 1.673 | −0.226 | 3.750 |
| 1.663 | −0.233 | 3.750 |
| 1.648 | −0.236 | 3.750 |
| 1.629 | −0.234 | 3.750 |
| 1.604 | −0.230 | 3.750 |
| 1.572 | −0.226 | 3.750 |
| 1.534 | −0.220 | 3.750 |
| 1.488 | −0.214 | 3.750 |
| 1.435 | −0.207 | 3.750 |
| 1.372 | −0.199 | 3.750 |
| 1.299 | −0.190 | 3.750 |
| 1.216 | −0.180 | 3.750 |
| 1.124 | −0.169 | 3.750 |
| 1.022 | −0.158 | 3.750 |
| 0.910 | −0.146 | 3.750 |
| 0.793 | −0.134 | 3.750 |
| 0.671 | −0.121 | 3.750 |
| 0.545 | −0.108 | 3.750 |
| 0.413 | −0.095 | 3.750 |
| 0.277 | −0.082 | 3.750 |
| 0.135 | −0.068 | 3.750 |
| −0.011 | −0.054 | 3.750 |
| −0.157 | −0.040 | 3.750 |
| −0.303 | −0.026 | 3.750 |
| −0.450 | −0.012 | 3.750 |
| −0.596 | 0.001 | 3.750 |
| −0.742 | 0.015 | 3.750 |
| −0.888 | 0.029 | 3.750 |
| −1.035 | 0.042 | 3.750 |
| −1.181 | 0.055 | 3.750 |
| −1.327 | 0.068 | 3.750 |
| −1.473 | 0.081 | 3.750 |
| −1.620 | 0.093 | 3.750 |
| −1.761 | 0.104 | 3.750 |
| −1.898 | 0.114 | 3.750 |
| −2.030 | 0.123 | 3.750 |
| −2.157 | 0.130 | 3.750 |
| −2.279 | 0.136 | 3.750 |
| −2.397 | 0.143 | 3.750 |
| −2.509 | 0.149 | 3.750 |
| −2.617 | 0.154 | 3.750 |
| −2.715 | 0.159 | 3.750 |
| −2.803 | 0.162 | 3.750 |
| −2.881 | 0.164 | 3.750 |
| −2.954 | 0.165 | 3.750 |
| −3.018 | 0.166 | 3.750 |
| −3.067 | 0.167 | 3.750 |
| −3.106 | 0.170 | 3.750 |
| −3.135 | 0.175 | 3.750 |
| −3.156 | 0.183 | 3.750 |
| −3.166 | 0.190 | 3.750 |
| −3.171 | 0.196 | 3.750 |
| −3.173 | 0.200 | 3.750 |
| −3.173 | 0.201 | 3.750 |
| −3.174 | 0.202 | 3.750 |
| | Section K-K | |
| −3.105 | 0.197 | 4.286 |
| −3.105 | 0.198 | 4.286 |
| −3.106 | 0.202 | 4.286 |
| −3.106 | 0.210 | 4.286 |
| −3.102 | 0.222 | 4.286 |
| −3.089 | 0.240 | 4.286 |
| −3.068 | 0.261 | 4.286 |
| −3.035 | 0.284 | 4.286 |
| −2.993 | 0.309 | 4.286 |

TABLE 1-continued

| X | Y | Z |
|---|---|---|
| −2.935 | 0.337 | 4.286 |
| −2.865 | 0.365 | 4.286 |
| −2.790 | 0.388 | 4.286 |
| −2.703 | 0.410 | 4.286 |
| −2.606 | 0.428 | 4.286 |
| −2.498 | 0.442 | 4.286 |
| −2.384 | 0.452 | 4.286 |
| −2.265 | 0.457 | 4.286 |
| −2.141 | 0.457 | 4.286 |
| −2.013 | 0.451 | 4.286 |
| −1.879 | 0.442 | 4.286 |
| −1.741 | 0.430 | 4.286 |
| −1.599 | 0.415 | 4.286 |
| −1.452 | 0.398 | 4.286 |
| −1.305 | 0.378 | 4.286 |
| −1.158 | 0.357 | 4.286 |
| −1.012 | 0.334 | 4.286 |
| −0.866 | 0.311 | 4.286 |
| −0.720 | 0.286 | 4.286 |
| −0.575 | 0.260 | 4.286 |
| −0.429 | 0.233 | 4.286 |
| −0.284 | 0.205 | 4.286 |
| −0.138 | 0.177 | 4.286 |
| 0.007 | 0.148 | 4.286 |
| 0.152 | 0.119 | 4.286 |
| 0.292 | 0.090 | 4.286 |
| 0.428 | 0.063 | 4.286 |
| 0.558 | 0.036 | 4.286 |
| 0.684 | 0.010 | 4.286 |
| 0.805 | −0.015 | 4.286 |
| 0.921 | −0.039 | 4.286 |
| 1.032 | −0.061 | 4.286 |
| 1.134 | −0.082 | 4.286 |
| 1.226 | −0.100 | 4.286 |
| 1.308 | −0.117 | 4.286 |
| 1.381 | −0.131 | 4.286 |
| 1.444 | −0.143 | 4.286 |
| 1.497 | −0.152 | 4.286 |
| 1.543 | −0.161 | 4.286 |
| 1.581 | −0.168 | 4.286 |
| 1.613 | −0.173 | 4.286 |
| 1.638 | −0.178 | 4.286 |
| 1.657 | −0.181 | 4.286 |
| 1.670 | −0.188 | 4.286 |
| 1.678 | −0.198 | 4.286 |
| 1.680 | −0.208 | 4.286 |
| 1.680 | −0.215 | 4.286 |
| 1.678 | −0.222 | 4.286 |
| 1.673 | −0.231 | 4.286 |
| 1.663 | −0.238 | 4.286 |
| 1.649 | −0.240 | 4.286 |
| 1.629 | −0.238 | 4.286 |
| 1.605 | −0.234 | 4.286 |
| 1.574 | −0.230 | 4.286 |
| 1.536 | −0.224 | 4.286 |
| 1.491 | −0.218 | 4.286 |
| 1.438 | −0.211 | 4.286 |
| 1.376 | −0.203 | 4.286 |
| 1.304 | −0.194 | 4.286 |
| 1.223 | −0.184 | 4.286 |
| 1.132 | −0.174 | 4.286 |
| 1.031 | −0.162 | 4.286 |
| 0.921 | −0.150 | 4.286 |
| 0.806 | −0.138 | 4.286 |
| 0.686 | −0.125 | 4.286 |
| 0.561 | −0.113 | 4.286 |
| 0.431 | −0.100 | 4.286 |
| 0.297 | −0.086 | 4.286 |
| 0.157 | −0.072 | 4.286 |
| 0.013 | −0.058 | 4.286 |
| −0.131 | −0.044 | 4.286 |
| −0.275 | −0.030 | 4.286 |
| −0.419 | −0.016 | 4.286 |
| −0.563 | −0.002 | 4.286 |
| −0.707 | 0.011 | 4.286 |
| −0.851 | 0.025 | 4.286 |
| −0.995 | 0.039 | 4.286 |
| −1.140 | 0.052 | 4.286 |

TABLE 1-continued

| X | Y | Z |
|---|---|---|
| −1.284 | 0.065 | 4.286 |
| −1.428 | 0.078 | 4.286 |
| −1.572 | 0.090 | 4.286 |
| −1.712 | 0.101 | 4.286 |
| −1.847 | 0.111 | 4.286 |
| −1.977 | 0.120 | 4.286 |
| −2.102 | 0.127 | 4.286 |
| −2.222 | 0.133 | 4.286 |
| −2.338 | 0.140 | 4.286 |
| −2.449 | 0.146 | 4.286 |
| −2.555 | 0.151 | 4.286 |
| −2.651 | 0.156 | 4.286 |
| −2.738 | 0.158 | 4.286 |
| −2.815 | 0.160 | 4.286 |
| −2.888 | 0.161 | 4.286 |
| −2.950 | 0.162 | 4.286 |
| −2.999 | 0.163 | 4.286 |
| −3.037 | 0.165 | 4.286 |
| −3.066 | 0.169 | 4.286 |
| −3.086 | 0.177 | 4.286 |
| −3.096 | 0.184 | 4.286 |
| −3.101 | 0.190 | 4.286 |
| −3.103 | 0.193 | 4.286 |
| −3.104 | 0.195 | 4.286 |
| −3.104 | 0.196 | 4.286 |
| Section L-L | | |
| −2.966 | 0.183 | 5.357 |
| −2.967 | 0.185 | 5.357 |
| −2.967 | 0.189 | 5.357 |
| −2.967 | 0.197 | 5.357 |
| −2.962 | 0.208 | 5.357 |
| −2.949 | 0.225 | 5.357 |
| −2.927 | 0.244 | 5.357 |
| −2.895 | 0.265 | 5.357 |
| −2.853 | 0.289 | 5.357 |
| −2.796 | 0.315 | 5.357 |
| −2.728 | 0.340 | 5.357 |
| −2.655 | 0.362 | 5.357 |
| −2.570 | 0.382 | 5.357 |
| −2.476 | 0.398 | 5.357 |
| −2.372 | 0.411 | 5.357 |
| −2.262 | 0.419 | 5.357 |
| −2.148 | 0.424 | 5.357 |
| −2.028 | 0.423 | 5.357 |
| −1.903 | 0.418 | 5.357 |
| −1.774 | 0.409 | 5.357 |
| −1.640 | 0.397 | 5.357 |
| −1.502 | 0.382 | 5.357 |
| −1.359 | 0.365 | 5.357 |
| −1.217 | 0.346 | 5.357 |
| −1.075 | 0.326 | 5.357 |
| −0.933 | 0.304 | 5.357 |
| −0.791 | 0.281 | 5.357 |
| −0.650 | 0.257 | 5.357 |
| −0.508 | 0.232 | 5.357 |
| −0.367 | 0.206 | 5.357 |
| −0.226 | 0.180 | 5.357 |
| −0.085 | 0.153 | 5.357 |
| 0.056 | 0.125 | 5.357 |
| 0.197 | 0.097 | 5.357 |
| 0.333 | 0.070 | 5.357 |
| 0.464 | 0.043 | 5.357 |
| 0.591 | 0.017 | 5.357 |
| 0.713 | −0.008 | 5.357 |
| 0.830 | −0.031 | 5.357 |
| 0.943 | −0.054 | 5.357 |
| 1.051 | −0.076 | 5.357 |
| 1.149 | −0.096 | 5.357 |
| 1.238 | −0.114 | 5.357 |
| 1.318 | −0.129 | 5.357 |
| 1.389 | −0.143 | 5.357 |
| 1.450 | −0.154 | 5.357 |
| 1.502 | −0.164 | 5.357 |
| 1.546 | −0.172 | 5.357 |
| 1.583 | −0.179 | 5.357 |
| 1.614 | −0.184 | 5.357 |
| 1.638 | −0.188 | 5.357 |

TABLE 1-continued

| X | Y | Z |
|---|---|---|
| 1.657 | −0.192 | 5.357 |
| 1.670 | −0.198 | 5.357 |
| 1.678 | −0.207 | 5.357 |
| 1.680 | −0.216 | 5.357 |
| 1.680 | −0.223 | 5.357 |
| 1.678 | −0.230 | 5.357 |
| 1.673 | −0.238 | 5.357 |
| 1.663 | −0.245 | 5.357 |
| 1.650 | −0.247 | 5.357 |
| 1.631 | −0.244 | 5.357 |
| 1.607 | −0.240 | 5.357 |
| 1.577 | −0.236 | 5.357 |
| 1.540 | −0.231 | 5.357 |
| 1.497 | −0.225 | 5.357 |
| 1.446 | −0.218 | 5.357 |
| 1.385 | −0.210 | 5.357 |
| 1.315 | −0.201 | 5.357 |
| 1.236 | −0.192 | 5.357 |
| 1.148 | −0.181 | 5.357 |
| 1.050 | −0.170 | 5.357 |
| 0.943 | −0.158 | 5.357 |
| 0.831 | −0.146 | 5.357 |
| 0.715 | −0.133 | 5.357 |
| 0.594 | −0.120 | 5.357 |
| 0.468 | −0.107 | 5.357 |
| 0.337 | −0.094 | 5.357 |
| 0.202 | −0.080 | 5.357 |
| 0.062 | −0.066 | 5.357 |
| −0.078 | −0.052 | 5.357 |
| −0.218 | −0.038 | 5.357 |
| −0.357 | −0.024 | 5.357 |
| −0.497 | −0.010 | 5.357 |
| −0.637 | 0.003 | 5.357 |
| −0.777 | 0.017 | 5.357 |
| −0.917 | 0.031 | 5.357 |
| −1.057 | 0.044 | 5.357 |
| −1.197 | 0.057 | 5.357 |
| −1.337 | 0.070 | 5.357 |
| −1.477 | 0.082 | 5.357 |
| −1.613 | 0.093 | 5.357 |
| −1.743 | 0.103 | 5.357 |
| −1.870 | 0.111 | 5.357 |
| −1.991 | 0.119 | 5.357 |
| −2.108 | 0.125 | 5.357 |
| −2.221 | 0.132 | 5.357 |
| −2.328 | 0.138 | 5.357 |
| −2.431 | 0.143 | 5.357 |
| −2.525 | 0.147 | 5.357 |
| −2.609 | 0.150 | 5.357 |
| −2.684 | 0.151 | 5.357 |
| −2.754 | 0.152 | 5.357 |
| −2.815 | 0.152 | 5.357 |
| −2.862 | 0.153 | 5.357 |
| −2.900 | 0.155 | 5.357 |
| −2.928 | 0.159 | 5.357 |
| −2.948 | 0.165 | 5.357 |
| −2.958 | 0.171 | 5.357 |
| −2.963 | 0.176 | 5.357 |
| −2.965 | 0.180 | 5.357 |
| −2.966 | 0.181 | 5.357 |
| −2.966 | 0.182 | 5.357 |
| | Section M-M | |
| −2.828 | 0.170 | 6.429 |
| −2.829 | 0.172 | 6.429 |
| −2.829 | 0.175 | 6.429 |
| −2.828 | 0.183 | 6.429 |
| −2.823 | 0.193 | 6.429 |
| −2.809 | 0.209 | 6.429 |
| −2.788 | 0.227 | 6.429 |
| −2.756 | 0.247 | 6.429 |
| −2.715 | 0.269 | 6.429 |
| −2.660 | 0.294 | 6.429 |
| −2.595 | 0.317 | 6.429 |
| −2.523 | 0.338 | 6.429 |
| −2.441 | 0.356 | 6.429 |
| −2.350 | 0.371 | 6.429 |
| −2.248 | 0.383 | 6.429 |

TABLE 1-continued

| X | Y | Z |
|---|---|---|
| −2.142 | 0.391 | 6.429 |
| −2.030 | 0.395 | 6.429 |
| −1.914 | 0.394 | 6.429 |
| −1.794 | 0.389 | 6.429 |
| −1.669 | 0.380 | 6.429 |
| −1.539 | 0.368 | 6.429 |
| −1.405 | 0.354 | 6.429 |
| −1.267 | 0.338 | 6.429 |
| −1.129 | 0.319 | 6.429 |
| −0.991 | 0.300 | 6.429 |
| −0.853 | 0.278 | 6.429 |
| −0.716 | 0.256 | 6.429 |
| −0.579 | 0.233 | 6.429 |
| −0.442 | 0.209 | 6.429 |
| −0.305 | 0.184 | 6.429 |
| −0.168 | 0.159 | 6.429 |
| −0.031 | 0.133 | 6.429 |
| 0.105 | 0.106 | 6.429 |
| 0.242 | 0.079 | 6.429 |
| 0.374 | 0.053 | 6.429 |
| 0.501 | 0.027 | 6.429 |
| 0.624 | 0.002 | 6.429 |
| 0.742 | −0.022 | 6.429 |
| 0.856 | −0.045 | 6.429 |
| 0.965 | −0.067 | 6.429 |
| 1.069 | −0.088 | 6.429 |
| 1.165 | −0.107 | 6.429 |
| 1.251 | −0.124 | 6.429 |
| 1.329 | −0.139 | 6.429 |
| 1.397 | −0.152 | 6.429 |
| 1.456 | −0.163 | 6.429 |
| 1.507 | −0.172 | 6.429 |
| 1.549 | −0.180 | 6.429 |
| 1.586 | −0.186 | 6.429 |
| 1.615 | −0.192 | 6.429 |
| 1.639 | −0.196 | 6.429 |
| 1.657 | −0.199 | 6.429 |
| 1.670 | −0.204 | 6.429 |
| 1.678 | −0.213 | 6.429 |
| 1.680 | −0.222 | 6.429 |
| 1.680 | −0.229 | 6.429 |
| 1.678 | −0.236 | 6.429 |
| 1.673 | −0.243 | 6.429 |
| 1.663 | −0.250 | 6.429 |
| 1.650 | −0.251 | 6.429 |
| 1.632 | −0.248 | 6.429 |
| 1.609 | −0.245 | 6.429 |
| 1.579 | −0.241 | 6.429 |
| 1.544 | −0.236 | 6.429 |
| 1.501 | −0.230 | 6.429 |
| 1.452 | −0.223 | 6.429 |
| 1.393 | −0.215 | 6.429 |
| 1.326 | −0.207 | 6.429 |
| 1.249 | −0.197 | 6.429 |
| 1.163 | −0.187 | 6.429 |
| 1.068 | −0.176 | 6.429 |
| 0.965 | −0.164 | 6.429 |
| 0.856 | −0.152 | 6.429 |
| 0.743 | −0.140 | 6.429 |
| 0.626 | −0.127 | 6.429 |
| 0.503 | −0.114 | 6.429 |
| 0.377 | −0.101 | 6.429 |
| 0.246 | −0.088 | 6.429 |
| 0.110 | −0.074 | 6.429 |
| −0.026 | −0.060 | 6.429 |
| −0.161 | −0.046 | 6.429 |
| −0.297 | −0.032 | 6.429 |
| −0.433 | −0.019 | 6.429 |
| −0.568 | −0.005 | 6.429 |
| −0.704 | 0.008 | 6.429 |
| −0.840 | 0.022 | 6.429 |
| −0.976 | 0.035 | 6.429 |
| −1.111 | 0.048 | 6.429 |
| −1.247 | 0.060 | 6.429 |
| −1.383 | 0.073 | 6.429 |
| −1.514 | 0.084 | 6.429 |
| −1.641 | 0.093 | 6.429 |
| −1.764 | 0.102 | 6.429 |

TABLE 1-continued

| X | Y | Z |
|---|---|---|
| −1.882 | 0.109 | 6.429 |
| −1.995 | 0.116 | 6.429 |
| −2.104 | 0.123 | 6.429 |
| −2.208 | 0.128 | 6.429 |
| −2.308 | 0.134 | 6.429 |
| −2.399 | 0.138 | 6.429 |
| −2.481 | 0.140 | 6.429 |
| −2.554 | 0.141 | 6.429 |
| −2.622 | 0.142 | 6.429 |
| −2.681 | 0.142 | 6.429 |
| −2.726 | 0.143 | 6.429 |
| −2.763 | 0.144 | 6.429 |
| −2.790 | 0.147 | 6.429 |
| −2.810 | 0.153 | 6.429 |
| −2.820 | 0.158 | 6.429 |
| −2.825 | 0.163 | 6.429 |
| −2.827 | 0.166 | 6.429 |
| −2.828 | 0.168 | 6.429 |
| −2.828 | 0.169 | 6.429 |
| Section N-N | | |
| −2.690 | 0.157 | 7.501 |
| −2.691 | 0.158 | 7.501 |
| −2.691 | 0.162 | 7.501 |
| −2.689 | 0.169 | 7.501 |
| −2.684 | 0.179 | 7.501 |
| −2.670 | 0.194 | 7.501 |
| −2.649 | 0.211 | 7.501 |
| −2.619 | 0.230 | 7.501 |
| −2.579 | 0.251 | 7.501 |
| −2.525 | 0.274 | 7.501 |
| −2.461 | 0.296 | 7.501 |
| −2.392 | 0.315 | 7.501 |
| −2.313 | 0.332 | 7.501 |
| −2.224 | 0.347 | 7.501 |
| −2.125 | 0.358 | 7.501 |
| −2.022 | 0.365 | 7.501 |
| −1.914 | 0.368 | 7.501 |
| −1.802 | 0.367 | 7.501 |
| −1.685 | 0.362 | 7.501 |
| −1.564 | 0.354 | 7.501 |
| −1.439 | 0.342 | 7.501 |
| −1.309 | 0.329 | 7.501 |
| −1.175 | 0.313 | 7.501 |
| −1.041 | 0.295 | 7.501 |
| −0.908 | 0.276 | 7.501 |
| −0.774 | 0.256 | 7.501 |
| −0.641 | 0.234 | 7.501 |
| −0.508 | 0.212 | 7.501 |
| −0.376 | 0.189 | 7.501 |
| −0.243 | 0.165 | 7.501 |
| −0.111 | 0.140 | 7.501 |
| 0.022 | 0.115 | 7.501 |
| 0.154 | 0.090 | 7.501 |
| 0.287 | 0.064 | 7.501 |
| 0.414 | 0.038 | 7.501 |
| 0.538 | 0.014 | 7.501 |
| 0.657 | −0.010 | 7.501 |
| 0.771 | −0.033 | 7.501 |
| 0.881 | −0.056 | 7.501 |
| 0.987 | −0.077 | 7.501 |
| 1.088 | −0.097 | 7.501 |
| 1.181 | −0.115 | 7.501 |
| 1.265 | −0.132 | 7.501 |
| 1.340 | −0.146 | 7.501 |
| 1.406 | −0.159 | 7.501 |
| 1.463 | −0.170 | 7.501 |
| 1.512 | −0.179 | 7.501 |
| 1.553 | −0.186 | 7.501 |
| 1.588 | −0.192 | 7.501 |
| 1.617 | −0.197 | 7.501 |
| 1.640 | −0.202 | 7.501 |
| 1.658 | −0.205 | 7.501 |
| 1.670 | −0.210 | 7.501 |
| 1.678 | −0.218 | 7.501 |
| 1.680 | −0.227 | 7.501 |
| 1.680 | −0.234 | 7.501 |
| 1.678 | −0.240 | 7.501 |

TABLE 1-continued

| X | Y | Z |
|---|---|---|
| 1.673 | −0.247 | 7.501 |
| 1.664 | −0.253 | 7.501 |
| 1.651 | −0.255 | 7.501 |
| 1.634 | −0.252 | 7.501 |
| 1.611 | −0.249 | 7.501 |
| 1.583 | −0.245 | 7.501 |
| 1.548 | −0.240 | 7.501 |
| 1.507 | −0.234 | 7.501 |
| 1.459 | −0.227 | 7.501 |
| 1.402 | −0.220 | 7.501 |
| 1.337 | −0.211 | 7.501 |
| 1.262 | −0.202 | 7.501 |
| 1.179 | −0.192 | 7.501 |
| 1.087 | −0.181 | 7.501 |
| 0.987 | −0.170 | 7.501 |
| 0.881 | −0.158 | 7.501 |
| 0.772 | −0.146 | 7.501 |
| 0.658 | −0.134 | 7.501 |
| 0.540 | −0.121 | 7.501 |
| 0.417 | −0.108 | 7.501 |
| 0.290 | −0.095 | 7.501 |
| 0.158 | −0.081 | 7.501 |
| 0.027 | −0.067 | 7.501 |
| −0.105 | −0.054 | 7.501 |
| −0.236 | −0.040 | 7.501 |
| −0.368 | −0.027 | 7.501 |
| −0.499 | −0.013 | 7.501 |
| −0.631 | 0.000 | 7.501 |
| −0.762 | 0.013 | 7.501 |
| −0.894 | 0.026 | 7.501 |
| −1.025 | 0.038 | 7.501 |
| −1.157 | 0.051 | 7.501 |
| −1.289 | 0.063 | 7.501 |
| −1.416 | 0.074 | 7.501 |
| −1.539 | 0.083 | 7.501 |
| −1.658 | 0.092 | 7.501 |
| −1.772 | 0.099 | 7.501 |
| −1.882 | 0.106 | 7.501 |
| −1.988 | 0.112 | 7.501 |
| −2.089 | 0.118 | 7.501 |
| −2.186 | 0.123 | 7.501 |
| −2.274 | 0.127 | 7.501 |
| −2.353 | 0.129 | 7.501 |
| −2.423 | 0.131 | 7.501 |
| −2.490 | 0.131 | 7.501 |
| −2.547 | 0.131 | 7.501 |
| −2.591 | 0.132 | 7.501 |
| −2.626 | 0.133 | 7.501 |
| −2.652 | 0.136 | 7.501 |
| −2.672 | 0.140 | 7.501 |
| −2.682 | 0.145 | 7.501 |
| −2.687 | 0.150 | 7.501 |
| −2.689 | 0.153 | 7.501 |
| −2.690 | 0.155 | 7.501 |
| −2.690 | 0.156 | 7.501 |
| Section P-P | | |
| −2.552 | 0.143 | 8.573 |
| −2.553 | 0.145 | 8.573 |
| −2.553 | 0.148 | 8.573 |
| −2.551 | 0.155 | 8.573 |
| −2.545 | 0.165 | 8.573 |
| −2.532 | 0.179 | 8.573 |
| −2.511 | 0.195 | 8.573 |
| −2.482 | 0.213 | 8.573 |
| −2.443 | 0.233 | 8.573 |
| −2.391 | 0.255 | 8.573 |
| −2.329 | 0.276 | 8.573 |
| −2.261 | 0.294 | 8.573 |
| −2.185 | 0.310 | 8.573 |
| −2.099 | 0.324 | 8.573 |
| −2.004 | 0.334 | 8.573 |
| −1.904 | 0.341 | 8.573 |
| −1.799 | 0.344 | 8.573 |
| −1.690 | 0.343 | 8.573 |
| −1.577 | 0.338 | 8.573 |
| −1.460 | 0.330 | 8.573 |
| −1.339 | 0.319 | 8.573 |

TABLE 1-continued

| X | Y | Z |
|---|---|---|
| −1.213 | 0.305 | 8.573 |
| −1.084 | 0.290 | 8.573 |
| −0.954 | 0.273 | 8.573 |
| −0.825 | 0.254 | 8.573 |
| −0.696 | 0.235 | 8.573 |
| −0.567 | 0.214 | 8.573 |
| −0.438 | 0.193 | 8.573 |
| −0.310 | 0.170 | 8.573 |
| −0.181 | 0.147 | 8.573 |
| −0.053 | 0.124 | 8.573 |
| 0.075 | 0.099 | 8.573 |
| 0.203 | 0.075 | 8.573 |
| 0.331 | 0.050 | 8.573 |
| 0.455 | 0.025 | 8.573 |
| 0.574 | 0.001 | 8.573 |
| 0.689 | −0.022 | 8.573 |
| 0.800 | −0.044 | 8.573 |
| 0.907 | −0.065 | 8.573 |
| 1.009 | −0.086 | 8.573 |
| 1.107 | −0.105 | 8.573 |
| 1.197 | −0.123 | 8.573 |
| 1.278 | −0.139 | 8.573 |
| 1.351 | −0.153 | 8.573 |
| 1.415 | −0.165 | 8.573 |
| 1.470 | −0.175 | 8.573 |
| 1.517 | −0.184 | 8.573 |
| 1.558 | −0.191 | 8.573 |
| 1.591 | −0.197 | 8.573 |
| 1.619 | −0.202 | 8.573 |
| 1.642 | −0.206 | 8.573 |
| 1.659 | −0.209 | 8.573 |
| 1.671 | −0.214 | 8.573 |
| 1.678 | −0.222 | 8.573 |
| 1.680 | −0.231 | 8.573 |
| 1.680 | −0.237 | 8.573 |
| 1.678 | −0.244 | 8.573 |
| 1.673 | −0.251 | 8.573 |
| 1.664 | −0.257 | 8.573 |
| 1.652 | −0.258 | 8.573 |
| 1.635 | −0.255 | 8.573 |
| 1.613 | −0.252 | 8.573 |
| 1.585 | −0.248 | 8.573 |
| 1.552 | −0.243 | 8.573 |
| 1.512 | −0.238 | 8.573 |
| 1.466 | −0.231 | 8.573 |
| 1.411 | −0.224 | 8.573 |
| 1.347 | −0.216 | 8.573 |
| 1.275 | −0.207 | 8.573 |
| 1.195 | −0.197 | 8.573 |
| 1.106 | −0.186 | 8.573 |
| 1.008 | −0.175 | 8.573 |
| 0.906 | −0.164 | 8.573 |
| 0.800 | −0.152 | 8.573 |
| 0.690 | −0.140 | 8.573 |
| 0.576 | −0.127 | 8.573 |
| 0.457 | −0.115 | 8.573 |
| 0.334 | −0.102 | 8.573 |
| 0.206 | −0.088 | 8.573 |
| 0.079 | −0.075 | 8.573 |
| −0.048 | −0.062 | 8.573 |
| −0.176 | −0.048 | 8.573 |
| −0.303 | −0.035 | 8.573 |
| −0.430 | −0.022 | 8.573 |
| −0.558 | −0.009 | 8.573 |
| −0.685 | 0.003 | 8.573 |
| −0.812 | 0.016 | 8.573 |
| −0.940 | 0.029 | 8.573 |
| −1.067 | 0.041 | 8.573 |
| −1.195 | 0.052 | 8.573 |
| −1.318 | 0.063 | 8.573 |
| −1.437 | 0.072 | 8.573 |
| −1.552 | 0.081 | 8.573 |
| −1.663 | 0.088 | 8.573 |
| −1.769 | 0.095 | 8.573 |
| −1.872 | 0.101 | 8.573 |
| −1.970 | 0.107 | 8.573 |
| −2.063 | 0.112 | 8.573 |
| −2.149 | 0.116 | 8.573 |

TABLE 1-continued

| X | Y | Z |
|---|---|---|
| −2.225 | 0.118 | 8.573 |
| −2.294 | 0.119 | 8.573 |
| −2.358 | 0.119 | 8.573 |
| −2.413 | 0.119 | 8.573 |
| −2.456 | 0.120 | 8.573 |
| −2.490 | 0.121 | 8.573 |
| −2.515 | 0.124 | 8.573 |
| −2.534 | 0.128 | 8.573 |
| −2.544 | 0.133 | 8.573 |
| −2.549 | 0.137 | 8.573 |
| −2.551 | 0.140 | 8.573 |
| −2.552 | 0.142 | 8.573 |
| −2.552 | 0.142 | 8.573 |
| Section R-R | | |
| −2.414 | 0.130 | 9.644 |
| −2.415 | 0.132 | 9.644 |
| −2.415 | 0.135 | 9.644 |
| −2.413 | 0.142 | 9.644 |
| −2.407 | 0.151 | 9.644 |
| −2.395 | 0.164 | 9.644 |
| −2.374 | 0.180 | 9.644 |
| −2.345 | 0.197 | 9.644 |
| −2.308 | 0.216 | 9.644 |
| −2.257 | 0.237 | 9.644 |
| −2.197 | 0.257 | 9.644 |
| −2.132 | 0.274 | 9.644 |
| −2.058 | 0.290 | 9.644 |
| −1.975 | 0.303 | 9.644 |
| −1.883 | 0.313 | 9.644 |
| −1.786 | 0.319 | 9.644 |
| −1.685 | 0.322 | 9.644 |
| −1.580 | 0.321 | 9.644 |
| −1.470 | 0.316 | 9.644 |
| −1.357 | 0.308 | 9.644 |
| −1.240 | 0.297 | 9.644 |
| −1.118 | 0.284 | 9.644 |
| −0.993 | 0.269 | 9.644 |
| −0.868 | 0.253 | 9.644 |
| −0.743 | 0.235 | 9.644 |
| −0.618 | 0.216 | 9.644 |
| −0.493 | 0.196 | 9.644 |
| −0.369 | 0.175 | 9.644 |
| −0.245 | 0.153 | 9.644 |
| −0.120 | 0.131 | 9.644 |
| 0.004 | 0.108 | 9.644 |
| 0.128 | 0.085 | 9.644 |
| 0.252 | 0.061 | 9.644 |
| 0.375 | 0.037 | 9.644 |
| 0.495 | 0.013 | 9.644 |
| 0.611 | −0.010 | 9.644 |
| 0.722 | −0.032 | 9.644 |
| 0.829 | −0.054 | 9.644 |
| 0.932 | −0.074 | 9.644 |
| 1.031 | −0.094 | 9.644 |
| 1.126 | −0.113 | 9.644 |
| 1.213 | −0.130 | 9.644 |
| 1.291 | −0.145 | 9.644 |
| 1.362 | −0.159 | 9.644 |
| 1.424 | −0.171 | 9.644 |
| 1.477 | −0.181 | 9.644 |
| 1.523 | −0.189 | 9.644 |
| 1.562 | −0.196 | 9.644 |
| 1.595 | −0.202 | 9.644 |
| 1.621 | −0.207 | 9.644 |
| 1.643 | −0.211 | 9.644 |
| 1.660 | −0.213 | 9.644 |
| 1.671 | −0.218 | 9.644 |
| 1.678 | −0.227 | 9.644 |
| 1.680 | −0.235 | 9.644 |
| 1.680 | −0.241 | 9.644 |
| 1.678 | −0.247 | 9.644 |
| 1.674 | −0.254 | 9.644 |
| 1.665 | −0.260 | 9.644 |
| 1.653 | −0.261 | 9.644 |
| 1.636 | −0.258 | 9.644 |
| 1.615 | −0.255 | 9.644 |
| 1.589 | −0.251 | 9.644 |

TABLE 1-continued

| X | Y | Z |
|---|---|---|
| 1.556 | −0.247 | 9.644 |
| 1.518 | −0.241 | 9.644 |
| 1.473 | −0.235 | 9.644 |
| 1.420 | −0.228 | 9.644 |
| 1.358 | −0.220 | 9.644 |
| 1.289 | −0.211 | 9.644 |
| 1.211 | −0.202 | 9.644 |
| 1.125 | −0.192 | 9.644 |
| 1.030 | −0.181 | 9.644 |
| 0.932 | −0.170 | 9.644 |
| 0.829 | −0.158 | 9.644 |
| 0.723 | −0.146 | 9.644 |
| 0.612 | −0.134 | 9.644 |
| 0.497 | −0.122 | 9.644 |
| 0.378 | −0.109 | 9.644 |
| 0.255 | −0.096 | 9.644 |
| 0.131 | −0.083 | 9.644 |
| 0.008 | −0.070 | 9.644 |
| −0.115 | −0.058 | 9.644 |
| −0.238 | −0.045 | 9.644 |
| −0.361 | −0.032 | 9.644 |
| −0.485 | −0.020 | 9.644 |
| −0.608 | −0.007 | 9.644 |
| −0.731 | 0.005 | 9.644 |
| −0.854 | 0.017 | 9.644 |
| −0.978 | 0.029 | 9.644 |
| −1.101 | 0.041 | 9.644 |
| −1.220 | 0.051 | 9.644 |
| −1.335 | 0.060 | 9.644 |
| −1.447 | 0.069 | 9.644 |
| −1.554 | 0.076 | 9.644 |
| −1.657 | 0.083 | 9.644 |
| −1.756 | 0.089 | 9.644 |
| −1.850 | 0.095 | 9.644 |
| −1.941 | 0.100 | 9.644 |
| −2.024 | 0.103 | 9.644 |
| −2.098 | 0.106 | 9.644 |
| −2.164 | 0.107 | 9.644 |
| −2.226 | 0.107 | 9.644 |
| −2.280 | 0.107 | 9.644 |
| −2.321 | 0.108 | 9.644 |
| −2.354 | 0.109 | 9.644 |
| −2.378 | 0.111 | 9.644 |
| −2.397 | 0.115 | 9.644 |
| −2.406 | 0.120 | 9.644 |
| −2.411 | 0.124 | 9.644 |
| −2.413 | 0.127 | 9.644 |
| −2.414 | 0.128 | 9.644 |
| −2.414 | 0.129 | 9.644 |
| | Section S-S | |
| −2.276 | 0.117 | 10.716 |
| −2.276 | 0.118 | 10.716 |
| −2.276 | 0.122 | 10.716 |
| −2.275 | 0.128 | 10.716 |
| −2.269 | 0.137 | 10.716 |
| −2.257 | 0.150 | 10.716 |
| −2.237 | 0.165 | 10.716 |
| −2.209 | 0.181 | 10.716 |
| −2.173 | 0.200 | 10.716 |
| −2.124 | 0.220 | 10.716 |
| −2.066 | 0.239 | 10.716 |
| −2.003 | 0.256 | 10.716 |
| −1.932 | 0.271 | 10.716 |
| −1.851 | 0.283 | 10.716 |
| −1.762 | 0.293 | 10.716 |
| −1.669 | 0.299 | 10.716 |
| −1.571 | 0.302 | 10.716 |
| −1.470 | 0.301 | 10.716 |
| −1.364 | 0.296 | 10.716 |
| −1.254 | 0.289 | 10.716 |
| −1.141 | 0.278 | 10.716 |
| −1.024 | 0.266 | 10.716 |
| −0.903 | 0.251 | 10.716 |
| −0.782 | 0.235 | 10.716 |
| −0.661 | 0.218 | 10.716 |
| −0.540 | 0.200 | 10.716 |
| −0.420 | 0.180 | 10.716 |

TABLE 1-continued

| X | Y | Z |
|---|---|---|
| −0.300 | 0.160 | 10.716 |
| −0.179 | 0.139 | 10.716 |
| −0.059 | 0.118 | 10.716 |
| 0.060 | 0.095 | 10.716 |
| 0.180 | 0.073 | 10.716 |
| 0.300 | 0.050 | 10.716 |
| 0.420 | 0.026 | 10.716 |
| 0.535 | 0.003 | 10.716 |
| 0.647 | −0.019 | 10.716 |
| 0.754 | −0.040 | 10.716 |
| 0.858 | −0.061 | 10.716 |
| 0.958 | −0.081 | 10.716 |
| 1.053 | −0.100 | 10.716 |
| 1.145 | −0.118 | 10.716 |
| 1.229 | −0.135 | 10.716 |
| 1.305 | −0.150 | 10.716 |
| 1.372 | −0.163 | 10.716 |
| 1.432 | −0.174 | 10.716 |
| 1.484 | −0.184 | 10.716 |
| 1.528 | −0.192 | 10.716 |
| 1.566 | −0.199 | 10.716 |
| 1.597 | −0.205 | 10.716 |
| 1.623 | −0.209 | 10.716 |
| 1.644 | −0.213 | 10.716 |
| 1.660 | −0.216 | 10.716 |
| 1.671 | −0.221 | 10.716 |
| 1.678 | −0.228 | 10.716 |
| 1.680 | −0.236 | 10.716 |
| 1.680 | −0.242 | 10.716 |
| 1.678 | −0.248 | 10.716 |
| 1.674 | −0.255 | 10.716 |
| 1.665 | −0.260 | 10.716 |
| 1.653 | −0.262 | 10.716 |
| 1.638 | −0.259 | 10.716 |
| 1.617 | −0.256 | 10.716 |
| 1.592 | −0.253 | 10.716 |
| 1.560 | −0.248 | 10.716 |
| 1.523 | −0.243 | 10.716 |
| 1.480 | −0.237 | 10.716 |
| 1.428 | −0.230 | 10.716 |
| 1.369 | −0.222 | 10.716 |
| 1.302 | −0.214 | 10.716 |
| 1.226 | −0.205 | 10.716 |
| 1.143 | −0.195 | 10.716 |
| 1.052 | −0.184 | 10.716 |
| 0.957 | −0.173 | 10.716 |
| 0.858 | −0.162 | 10.716 |
| 0.755 | −0.151 | 10.716 |
| 0.648 | −0.140 | 10.716 |
| 0.537 | −0.128 | 10.716 |
| 0.422 | −0.115 | 10.716 |
| 0.303 | −0.103 | 10.716 |
| 0.184 | −0.090 | 10.716 |
| 0.065 | −0.078 | 10.716 |
| −0.054 | −0.065 | 10.716 |
| −0.173 | −0.053 | 10.716 |
| −0.293 | −0.041 | 10.716 |
| −0.412 | −0.029 | 10.716 |
| −0.531 | −0.017 | 10.716 |
| −0.650 | −0.005 | 10.716 |
| −0.769 | 0.007 | 10.716 |
| −0.888 | 0.019 | 10.716 |
| −1.007 | 0.030 | 10.716 |
| −1.122 | 0.040 | 10.716 |
| −1.234 | 0.049 | 10.716 |
| −1.341 | 0.057 | 10.716 |
| −1.445 | 0.064 | 10.716 |
| −1.544 | 0.071 | 10.716 |
| −1.640 | 0.077 | 10.716 |
| −1.731 | 0.083 | 10.716 |
| −1.819 | 0.087 | 10.716 |
| −1.898 | 0.091 | 10.716 |
| −1.970 | 0.093 | 10.716 |
| −2.034 | 0.094 | 10.716 |
| −2.094 | 0.095 | 10.716 |
| −2.146 | 0.095 | 10.716 |
| −2.186 | 0.095 | 10.716 |
| −2.218 | 0.096 | 10.716 |

TABLE 1-continued

| X | Y | Z |
|---|---|---|
| −2.241 | 0.098 | 10.716 |
| −2.259 | 0.103 | 10.716 |
| −2.268 | 0.107 | 10.716 |
| −2.273 | 0.111 | 10.716 |
| −2.275 | 0.114 | 10.716 |
| −2.275 | 0.115 | 10.716 |
| −2.276 | 0.116 | 10.716 |
| Section T-T | | |
| −2.138 | 0.103 | 11.787 |
| −2.138 | 0.105 | 11.787 |
| −2.138 | 0.108 | 11.787 |
| −2.136 | 0.114 | 11.787 |
| −2.131 | 0.123 | 11.787 |
| −2.119 | 0.135 | 11.787 |
| −2.100 | 0.150 | 11.787 |
| −2.074 | 0.166 | 11.787 |
| −2.038 | 0.184 | 11.787 |
| −1.991 | 0.204 | 11.787 |
| −1.936 | 0.222 | 11.787 |
| −1.875 | 0.239 | 11.787 |
| −1.806 | 0.254 | 11.787 |
| −1.728 | 0.266 | 11.787 |
| −1.642 | 0.276 | 11.787 |
| −1.552 | 0.282 | 11.787 |
| −1.458 | 0.285 | 11.787 |
| −1.360 | 0.285 | 11.787 |
| −1.258 | 0.281 | 11.787 |
| −1.152 | 0.274 | 11.787 |
| −1.043 | 0.264 | 11.787 |
| −0.930 | 0.252 | 11.787 |
| −0.813 | 0.239 | 11.787 |
| −0.696 | 0.224 | 11.787 |
| −0.579 | 0.208 | 11.787 |
| −0.463 | 0.190 | 11.787 |
| −0.347 | 0.172 | 11.787 |
| −0.231 | 0.153 | 11.787 |
| −0.115 | 0.133 | 11.787 |
| 0.001 | 0.112 | 11.787 |
| 0.117 | 0.091 | 11.787 |
| 0.233 | 0.069 | 11.787 |
| 0.348 | 0.047 | 11.787 |
| 0.464 | 0.024 | 11.787 |
| 0.575 | 0.002 | 11.787 |
| 0.683 | −0.019 | 11.787 |
| 0.787 | −0.040 | 11.787 |
| 0.887 | −0.060 | 11.787 |
| 0.983 | −0.079 | 11.787 |
| 1.075 | −0.097 | 11.787 |
| 1.164 | −0.115 | 11.787 |
| 1.244 | −0.131 | 11.787 |
| 1.318 | −0.145 | 11.787 |
| 1.383 | −0.158 | 11.787 |
| 1.441 | −0.169 | 11.787 |
| 1.491 | −0.178 | 11.787 |
| 1.533 | −0.186 | 11.787 |
| 1.570 | −0.193 | 11.787 |
| 1.600 | −0.198 | 11.787 |
| 1.625 | −0.203 | 11.787 |
| 1.645 | −0.206 | 11.787 |
| 1.661 | −0.209 | 11.787 |
| 1.672 | −0.213 | 11.787 |
| 1.678 | −0.221 | 11.787 |
| 1.680 | −0.229 | 11.787 |
| 1.680 | −0.235 | 11.787 |
| 1.678 | −0.240 | 11.787 |
| 1.674 | −0.247 | 11.787 |
| 1.666 | −0.252 | 11.787 |
| 1.654 | −0.253 | 11.787 |
| 1.639 | −0.251 | 11.787 |
| 1.619 | −0.248 | 11.787 |
| 1.595 | −0.244 | 11.787 |
| 1.565 | −0.240 | 11.787 |
| 1.529 | −0.235 | 11.787 |
| 1.487 | −0.229 | 11.787 |
| 1.437 | −0.223 | 11.787 |
| 1.380 | −0.215 | 11.787 |
| 1.315 | −0.207 | 11.787 |

TABLE 1-continued

| X | Y | Z |
|---|---|---|
| 1.242 | −0.198 | 11.787 |
| 1.162 | −0.189 | 11.787 |
| 1.074 | −0.179 | 11.787 |
| 0.982 | −0.168 | 11.787 |
| 0.887 | −0.158 | 11.787 |
| 0.787 | −0.147 | 11.787 |
| 0.684 | −0.136 | 11.787 |
| 0.577 | −0.125 | 11.787 |
| 0.466 | −0.113 | 11.787 |
| 0.351 | −0.101 | 11.787 |
| 0.236 | −0.089 | 11.787 |
| 0.121 | −0.077 | 11.787 |
| 0.006 | −0.065 | 11.787 |
| −0.109 | −0.054 | 11.787 |
| −0.223 | −0.042 | 11.787 |
| −0.338 | −0.031 | 11.787 |
| −0.453 | −0.019 | 11.787 |
| −0.568 | −0.008 | 11.787 |
| −0.683 | 0.003 | 11.787 |
| −0.798 | 0.014 | 11.787 |
| −0.913 | 0.024 | 11.787 |
| −1.024 | 0.033 | 11.787 |
| −1.132 | 0.042 | 11.787 |
| −1.235 | 0.049 | 11.787 |
| −1.335 | 0.056 | 11.787 |
| −1.431 | 0.062 | 11.787 |
| −1.523 | 0.068 | 11.787 |
| −1.612 | 0.073 | 11.787 |
| −1.696 | 0.078 | 11.787 |
| −1.773 | 0.081 | 11.787 |
| −1.843 | 0.083 | 11.787 |
| −1.904 | 0.083 | 11.787 |
| −1.962 | 0.083 | 11.787 |
| −2.012 | 0.083 | 11.787 |
| −2.050 | 0.083 | 11.787 |
| −2.081 | 0.084 | 11.787 |
| −2.104 | 0.086 | 11.787 |
| −2.121 | 0.090 | 11.787 |
| −2.130 | 0.094 | 11.787 |
| −2.135 | 0.098 | 11.787 |
| −2.136 | 0.100 | 11.787 |
| −2.137 | 0.102 | 11.787 |
| −2.137 | 0.103 | 11.787 |
| Section U-U | | |
| −1.999 | 0.090 | 12.859 |
| −1.999 | 0.092 | 12.859 |
| −1.999 | 0.095 | 12.859 |
| −1.998 | 0.100 | 12.859 |
| −1.993 | 0.109 | 12.859 |
| −1.982 | 0.121 | 12.859 |
| −1.963 | 0.135 | 12.859 |
| −1.938 | 0.151 | 12.859 |
| −1.904 | 0.168 | 12.859 |
| −1.859 | 0.188 | 12.859 |
| −1.805 | 0.206 | 12.859 |
| −1.747 | 0.223 | 12.859 |
| −1.681 | 0.239 | 12.859 |
| −1.606 | 0.252 | 12.859 |
| −1.524 | 0.262 | 12.859 |
| −1.437 | 0.269 | 12.859 |
| −1.346 | 0.272 | 12.859 |
| −1.252 | 0.273 | 12.859 |
| −1.153 | 0.270 | 12.859 |
| −1.051 | 0.264 | 12.859 |
| −0.946 | 0.256 | 12.859 |
| −0.837 | 0.245 | 12.859 |
| −0.724 | 0.233 | 12.859 |
| −0.611 | 0.220 | 12.859 |
| −0.498 | 0.205 | 12.859 |
| −0.386 | 0.189 | 12.859 |
| −0.274 | 0.173 | 12.859 |
| −0.162 | 0.155 | 12.859 |
| −0.050 | 0.136 | 12.859 |
| 0.062 | 0.117 | 12.859 |
| 0.173 | 0.097 | 12.859 |
| 0.285 | 0.077 | 12.859 |
| 0.396 | 0.056 | 12.859 |

TABLE 1-continued

| X | Y | Z |
|---|---|---|
| 0.507 | 0.034 | 12.859 |
| 0.615 | 0.014 | 12.859 |
| 0.719 | −0.007 | 12.859 |
| 0.819 | −0.027 | 12.859 |
| 0.915 | −0.046 | 12.859 |
| 1.008 | −0.064 | 12.859 |
| 1.097 | −0.082 | 12.859 |
| 1.182 | −0.099 | 12.859 |
| 1.260 | −0.114 | 12.859 |
| 1.331 | −0.128 | 12.859 |
| 1.394 | −0.140 | 12.859 |
| 1.450 | −0.150 | 12.859 |
| 1.498 | −0.159 | 12.859 |
| 1.539 | −0.167 | 12.859 |
| 1.574 | −0.173 | 12.859 |
| 1.603 | −0.178 | 12.859 |
| 1.627 | −0.183 | 12.859 |
| 1.647 | −0.186 | 12.859 |
| 1.662 | −0.189 | 12.859 |
| 1.672 | −0.193 | 12.859 |
| 1.678 | −0.200 | 12.859 |
| 1.680 | −0.208 | 12.859 |
| 1.680 | −0.214 | 12.859 |
| 1.678 | −0.219 | 12.859 |
| 1.674 | −0.225 | 12.859 |
| 1.666 | −0.230 | 12.859 |
| 1.655 | −0.231 | 12.859 |
| 1.641 | −0.229 | 12.859 |
| 1.622 | −0.226 | 12.859 |
| 1.598 | −0.223 | 12.859 |
| 1.569 | −0.219 | 12.859 |
| 1.534 | −0.214 | 12.859 |
| 1.494 | −0.208 | 12.859 |
| 1.446 | −0.202 | 12.859 |
| 1.391 | −0.195 | 12.859 |
| 1.328 | −0.187 | 12.859 |
| 1.258 | −0.179 | 12.859 |
| 1.181 | −0.170 | 12.859 |
| 1.096 | −0.160 | 12.859 |
| 1.008 | −0.150 | 12.859 |
| 0.916 | −0.140 | 12.859 |
| 0.820 | −0.130 | 12.859 |
| 0.720 | −0.120 | 12.859 |
| 0.617 | −0.109 | 12.859 |
| 0.510 | −0.098 | 12.859 |
| 0.399 | −0.087 | 12.859 |
| 0.289 | −0.076 | 12.859 |
| 0.178 | −0.065 | 12.859 |
| 0.067 | −0.054 | 12.859 |
| −0.043 | −0.043 | 12.859 |
| −0.154 | −0.033 | 12.859 |
| −0.265 | −0.023 | 12.859 |
| −0.376 | −0.012 | 12.859 |
| −0.486 | −0.003 | 12.859 |
| −0.597 | 0.007 | 12.859 |
| −0.708 | 0.016 | 12.859 |
| −0.819 | 0.025 | 12.859 |
| −0.926 | 0.034 | 12.859 |
| −1.030 | 0.041 | 12.859 |
| −1.130 | 0.047 | 12.859 |
| −1.226 | 0.053 | 12.859 |
| −1.318 | 0.059 | 12.859 |
| −1.407 | 0.064 | 12.859 |
| −1.492 | 0.068 | 12.859 |
| −1.574 | 0.071 | 12.859 |
| −1.648 | 0.073 | 12.859 |
| −1.715 | 0.074 | 12.859 |
| −1.774 | 0.073 | 12.859 |
| −1.830 | 0.072 | 12.859 |
| −1.878 | 0.071 | 12.859 |
| −1.915 | 0.071 | 12.859 |
| −1.945 | 0.071 | 12.859 |
| −1.967 | 0.073 | 12.859 |
| −1.983 | 0.077 | 12.859 |
| −1.992 | 0.081 | 12.859 |
| −1.996 | 0.085 | 12.859 |
| −1.998 | 0.087 | 12.859 |
| −1.999 | 0.089 | 12.859 |

TABLE 1-continued

| X | Y | Z |
|---|---|---|
| −1.999 | 0.089 | 12.859 |
| | Section V-V | |
| −1.861 | 0.077 | 13.930 |
| −1.861 | 0.078 | 13.930 |
| −1.861 | 0.081 | 13.930 |
| −1.860 | 0.087 | 13.930 |
| −1.855 | 0.095 | 13.930 |
| −1.844 | 0.107 | 13.930 |
| −1.827 | 0.120 | 13.930 |
| −1.802 | 0.136 | 13.930 |
| −1.770 | 0.153 | 13.930 |
| −1.726 | 0.172 | 13.930 |
| −1.675 | 0.191 | 13.930 |
| −1.619 | 0.209 | 13.930 |
| −1.556 | 0.225 | 13.930 |
| −1.485 | 0.239 | 13.930 |
| −1.406 | 0.251 | 13.930 |
| −1.323 | 0.259 | 13.930 |
| −1.236 | 0.264 | 13.930 |
| −1.145 | 0.266 | 13.930 |
| −1.050 | 0.265 | 13.930 |
| −0.952 | 0.261 | 13.930 |
| −0.850 | 0.254 | 13.930 |
| −0.745 | 0.246 | 13.930 |
| −0.636 | 0.236 | 13.930 |
| −0.527 | 0.225 | 13.930 |
| −0.419 | 0.212 | 13.930 |
| −0.310 | 0.199 | 13.930 |
| −0.202 | 0.184 | 13.930 |
| −0.094 | 0.168 | 13.930 |
| 0.013 | 0.151 | 13.930 |
| 0.121 | 0.134 | 13.930 |
| 0.229 | 0.116 | 13.930 |
| 0.336 | 0.097 | 13.930 |
| 0.444 | 0.077 | 13.930 |
| 0.551 | 0.058 | 13.930 |
| 0.654 | 0.038 | 13.930 |
| 0.755 | 0.019 | 13.930 |
| 0.851 | 0.000 | 13.930 |
| 0.944 | −0.018 | 13.930 |
| 1.033 | −0.035 | 13.930 |
| 1.119 | −0.052 | 13.930 |
| 1.201 | −0.068 | 13.930 |
| 1.276 | −0.082 | 13.930 |
| 1.344 | −0.095 | 13.930 |
| 1.404 | −0.107 | 13.930 |
| 1.458 | −0.117 | 13.930 |
| 1.505 | −0.126 | 13.930 |
| 1.544 | −0.133 | 13.930 |
| 1.578 | −0.139 | 13.930 |
| 1.606 | −0.144 | 13.930 |
| 1.629 | −0.148 | 13.930 |
| 1.648 | −0.151 | 13.930 |
| 1.662 | −0.154 | 13.930 |
| 1.672 | −0.158 | 13.930 |
| 1.678 | −0.165 | 13.930 |
| 1.680 | −0.172 | 13.930 |
| 1.680 | −0.178 | 13.930 |
| 1.679 | −0.183 | 13.930 |
| 1.675 | −0.189 | 13.930 |
| 1.667 | −0.193 | 13.930 |
| 1.657 | −0.195 | 13.930 |
| 1.643 | −0.193 | 13.930 |
| 1.625 | −0.190 | 13.930 |
| 1.602 | −0.187 | 13.930 |
| 1.574 | −0.183 | 13.930 |
| 1.541 | −0.178 | 13.930 |
| 1.502 | −0.173 | 13.930 |
| 1.456 | −0.167 | 13.930 |
| 1.403 | −0.160 | 13.930 |
| 1.342 | −0.153 | 13.930 |
| 1.275 | −0.145 | 13.930 |
| 1.201 | −0.136 | 13.930 |
| 1.119 | −0.127 | 13.930 |
| 1.034 | −0.118 | 13.930 |
| 0.945 | −0.109 | 13.930 |
| 0.853 | −0.100 | 13.930 |

TABLE 1-continued

| X | Y | Z |
|---|---|---|
| 0.757 | −0.090 | 13.930 |
| 0.658 | −0.080 | 13.930 |
| 0.555 | −0.070 | 13.930 |
| 0.448 | −0.060 | 13.930 |
| 0.342 | −0.050 | 13.930 |
| 0.235 | −0.040 | 13.930 |
| 0.129 | −0.031 | 13.930 |
| 0.022 | −0.022 | 13.930 |
| −0.085 | −0.013 | 13.930 |
| −0.191 | −0.004 | 13.930 |
| −0.298 | 0.004 | 13.930 |
| −0.405 | 0.013 | 13.930 |
| −0.511 | 0.020 | 13.930 |
| −0.618 | 0.028 | 13.930 |
| −0.725 | 0.035 | 13.930 |
| −0.828 | 0.041 | 13.930 |
| −0.928 | 0.046 | 13.930 |
| −1.024 | 0.051 | 13.930 |
| −1.117 | 0.055 | 13.930 |
| −1.206 | 0.059 | 13.930 |
| −1.291 | 0.063 | 13.930 |
| −1.373 | 0.066 | 13.930 |
| −1.452 | 0.067 | 13.930 |
| −1.523 | 0.067 | 13.930 |
| −1.587 | 0.066 | 13.930 |
| −1.644 | 0.064 | 13.930 |
| −1.698 | 0.062 | 13.930 |
| −1.744 | 0.060 | 13.930 |
| −1.780 | 0.059 | 13.930 |
| −1.808 | 0.059 | 13.930 |
| −1.830 | 0.061 | 13.930 |
| −1.845 | 0.064 | 13.930 |
| −1.854 | 0.068 | 13.930 |
| −1.858 | 0.072 | 13.930 |
| −1.860 | 0.074 | 13.930 |
| −1.860 | 0.075 | 13.930 |
| −1.861 | 0.076 | 13.930 |
| | Section W-W | |
| −1.723 | 0.064 | 15.002 |
| −1.723 | 0.065 | 15.002 |
| −1.723 | 0.068 | 15.002 |
| −1.722 | 0.073 | 15.002 |
| −1.718 | 0.081 | 15.002 |
| −1.707 | 0.093 | 15.002 |
| −1.691 | 0.106 | 15.002 |
| −1.667 | 0.121 | 15.002 |
| −1.637 | 0.138 | 15.002 |
| −1.595 | 0.157 | 15.002 |
| −1.547 | 0.177 | 15.002 |
| −1.494 | 0.195 | 15.002 |
| −1.433 | 0.213 | 15.002 |
| −1.365 | 0.228 | 15.002 |
| −1.289 | 0.242 | 15.002 |
| −1.209 | 0.252 | 15.002 |
| −1.125 | 0.259 | 15.002 |
| −1.038 | 0.264 | 15.002 |
| −0.947 | 0.265 | 15.002 |
| −0.853 | 0.264 | 15.002 |
| −0.755 | 0.260 | 15.002 |
| −0.653 | 0.255 | 15.002 |
| −0.549 | 0.248 | 15.002 |
| −0.444 | 0.240 | 15.002 |
| −0.340 | 0.230 | 15.002 |
| −0.235 | 0.219 | 15.002 |
| −0.131 | 0.206 | 15.002 |
| −0.027 | 0.193 | 15.002 |
| 0.077 | 0.178 | 15.002 |
| 0.180 | 0.163 | 15.002 |
| 0.284 | 0.147 | 15.002 |
| 0.387 | 0.130 | 15.002 |
| 0.491 | 0.112 | 15.002 |
| 0.594 | 0.094 | 15.002 |
| 0.694 | 0.076 | 15.002 |
| 0.790 | 0.059 | 15.002 |
| 0.883 | 0.042 | 15.002 |
| 0.972 | 0.025 | 15.002 |
| 1.058 | 0.009 | 15.002 |

TABLE 1-continued

| X | Y | Z |
|---|---|---|
| 1.140 | −0.007 | 15.002 |
| 1.219 | −0.022 | 15.002 |
| 1.291 | −0.035 | 15.002 |
| 1.357 | −0.048 | 15.002 |
| 1.415 | −0.059 | 15.002 |
| 1.467 | −0.068 | 15.002 |
| 1.511 | −0.076 | 15.002 |
| 1.549 | −0.083 | 15.002 |
| 1.582 | −0.089 | 15.002 |
| 1.609 | −0.094 | 15.002 |
| 1.631 | −0.098 | 15.002 |
| 1.649 | −0.101 | 15.002 |
| 1.663 | −0.103 | 15.002 |
| 1.672 | −0.107 | 15.002 |
| 1.678 | −0.114 | 15.002 |
| 1.680 | −0.121 | 15.002 |
| 1.680 | −0.126 | 15.002 |
| 1.679 | −0.131 | 15.002 |
| 1.675 | −0.137 | 15.002 |
| 1.667 | −0.142 | 15.002 |
| 1.657 | −0.143 | 15.002 |
| 1.644 | −0.141 | 15.002 |
| 1.626 | −0.138 | 15.002 |
| 1.604 | −0.135 | 15.002 |
| 1.577 | −0.131 | 15.002 |
| 1.545 | −0.127 | 15.002 |
| 1.508 | −0.122 | 15.002 |
| 1.464 | −0.116 | 15.002 |
| 1.413 | −0.110 | 15.002 |
| 1.355 | −0.103 | 15.002 |
| 1.290 | −0.096 | 15.002 |
| 1.219 | −0.088 | 15.002 |
| 1.141 | −0.080 | 15.002 |
| 1.059 | −0.071 | 15.002 |
| 0.974 | −0.063 | 15.002 |
| 0.885 | −0.055 | 15.002 |
| 0.793 | −0.046 | 15.002 |
| 0.697 | −0.037 | 15.002 |
| 0.598 | −0.029 | 15.002 |
| 0.496 | −0.020 | 15.002 |
| 0.394 | −0.012 | 15.002 |
| 0.291 | −0.003 | 15.002 |
| 0.189 | 0.004 | 15.002 |
| 0.086 | 0.012 | 15.002 |
| −0.016 | 0.019 | 15.002 |
| −0.119 | 0.025 | 15.002 |
| −0.221 | 0.032 | 15.002 |
| −0.324 | 0.038 | 15.002 |
| −0.426 | 0.043 | 15.002 |
| −0.529 | 0.048 | 15.002 |
| −0.631 | 0.052 | 15.002 |
| −0.731 | 0.056 | 15.002 |
| −0.827 | 0.059 | 15.002 |
| −0.919 | 0.061 | 15.002 |
| −1.008 | 0.063 | 15.002 |
| −1.094 | 0.064 | 15.002 |
| −1.176 | 0.065 | 15.002 |
| −1.255 | 0.065 | 15.002 |
| −1.330 | 0.064 | 15.002 |
| −1.399 | 0.062 | 15.002 |
| −1.460 | 0.059 | 15.002 |
| −1.515 | 0.056 | 15.002 |
| −1.566 | 0.053 | 15.002 |
| −1.611 | 0.050 | 15.002 |
| −1.645 | 0.048 | 15.002 |
| −1.672 | 0.048 | 15.002 |
| −1.693 | 0.049 | 15.002 |
| −1.708 | 0.052 | 15.002 |
| −1.716 | 0.055 | 15.002 |
| −1.720 | 0.059 | 15.002 |
| −1.722 | 0.061 | 15.002 |
| −1.722 | 0.062 | 15.002 |
| −1.723 | 0.063 | 15.002 |
| | Section X-X | |
| −1.654 | 0.057 | 15.537 |
| −1.654 | 0.058 | 15.537 |
| −1.654 | 0.061 | 15.537 |

TABLE 1-continued

| X | Y | Z |
|---|---|---|
| −1.653 | 0.066 | 15.537 |
| −1.649 | 0.074 | 15.537 |
| −1.639 | 0.085 | 15.537 |
| −1.623 | 0.098 | 15.537 |
| −1.600 | 0.114 | 15.537 |
| −1.570 | 0.130 | 15.537 |
| −1.530 | 0.150 | 15.537 |
| −1.482 | 0.170 | 15.537 |
| −1.431 | 0.189 | 15.537 |
| −1.372 | 0.207 | 15.537 |
| −1.305 | 0.223 | 15.537 |
| −1.231 | 0.238 | 15.537 |
| −1.153 | 0.250 | 15.537 |
| −1.071 | 0.258 | 15.537 |
| −0.986 | 0.264 | 15.537 |
| −0.896 | 0.267 | 15.537 |
| −0.804 | 0.268 | 15.537 |
| −0.708 | 0.266 | 15.537 |
| −0.608 | 0.262 | 15.537 |
| −0.506 | 0.257 | 15.537 |
| −0.403 | 0.250 | 15.537 |
| −0.300 | 0.241 | 15.537 |
| −0.198 | 0.232 | 15.537 |
| −0.096 | 0.220 | 15.537 |
| 0.006 | 0.208 | 15.537 |
| 0.108 | 0.195 | 15.537 |
| 0.210 | 0.181 | 15.537 |
| 0.311 | 0.166 | 15.537 |
| 0.413 | 0.150 | 15.537 |
| 0.514 | 0.133 | 15.537 |
| 0.615 | 0.116 | 15.537 |
| 0.713 | 0.099 | 15.537 |
| 0.807 | 0.083 | 15.537 |
| 0.898 | 0.066 | 15.537 |
| 0.986 | 0.050 | 15.537 |
| 1.070 | 0.035 | 15.537 |
| 1.151 | 0.020 | 15.537 |
| 1.228 | 0.005 | 15.537 |
| 1.299 | −0.008 | 15.537 |
| 1.363 | −0.020 | 15.537 |
| 1.420 | −0.030 | 15.537 |
| 1.471 | −0.040 | 15.537 |
| 1.515 | −0.048 | 15.537 |
| 1.552 | −0.054 | 15.537 |
| 1.584 | −0.060 | 15.537 |
| 1.610 | −0.065 | 15.537 |
| 1.632 | −0.069 | 15.537 |
| 1.650 | −0.072 | 15.537 |
| 1.663 | −0.074 | 15.537 |
| 1.673 | −0.078 | 15.537 |
| 1.678 | −0.085 | 15.537 |
| 1.680 | −0.091 | 15.537 |
| 1.680 | −0.096 | 15.537 |
| 1.679 | −0.101 | 15.537 |
| 1.675 | −0.107 | 15.537 |
| 1.668 | −0.111 | 15.537 |
| 1.658 | −0.113 | 15.537 |
| 1.645 | −0.111 | 15.537 |
| 1.627 | −0.108 | 15.537 |
| 1.606 | −0.105 | 15.537 |
| 1.579 | −0.101 | 15.537 |
| 1.548 | −0.097 | 15.537 |
| 1.512 | −0.092 | 15.537 |
| 1.468 | −0.087 | 15.537 |
| 1.418 | −0.081 | 15.537 |
| 1.362 | −0.074 | 15.537 |
| 1.298 | −0.067 | 15.537 |
| 1.228 | −0.060 | 15.537 |
| 1.152 | −0.052 | 15.537 |
| 1.071 | −0.044 | 15.537 |
| 0.988 | −0.036 | 15.537 |
| 0.901 | −0.028 | 15.537 |
| 0.811 | −0.020 | 15.537 |
| 0.717 | −0.012 | 15.537 |
| 0.620 | −0.004 | 15.537 |
| 0.520 | 0.003 | 15.537 |
| 0.420 | 0.011 | 15.537 |
| 0.319 | 0.018 | 15.537 |

TABLE 1-continued

| X | Y | Z |
|---|---|---|
| 0.219 | 0.025 | 15.537 |
| 0.119 | 0.032 | 15.537 |
| 0.018 | 0.038 | 15.537 |
| −0.082 | 0.043 | 15.537 |
| −0.183 | 0.048 | 15.537 |
| −0.283 | 0.053 | 15.537 |
| −0.384 | 0.057 | 15.537 |
| −0.484 | 0.060 | 15.537 |
| −0.585 | 0.063 | 15.537 |
| −0.682 | 0.065 | 15.537 |
| −0.776 | 0.067 | 15.537 |
| −0.867 | 0.067 | 15.537 |
| −0.954 | 0.068 | 15.537 |
| −1.038 | 0.068 | 15.537 |
| −1.118 | 0.067 | 15.537 |
| −1.196 | 0.066 | 15.537 |
| −1.269 | 0.063 | 15.537 |
| −1.336 | 0.060 | 15.537 |
| −1.397 | 0.056 | 15.537 |
| −1.450 | 0.052 | 15.537 |
| −1.500 | 0.048 | 15.537 |
| −1.544 | 0.045 | 15.537 |
| −1.577 | 0.043 | 15.537 |
| −1.604 | 0.042 | 15.537 |
| −1.624 | 0.043 | 15.537 |
| −1.639 | 0.045 | 15.537 |
| −1.647 | 0.049 | 15.537 |
| −1.651 | 0.052 | 15.537 |
| −1.653 | 0.054 | 15.537 |
| −1.653 | 0.056 | 15.537 |
| −1.654 | 0.056 | 15.537 |
| Section Y-Y | | |
| −1.585 | 0.050 | 16.073 |
| −1.585 | 0.052 | 16.073 |
| −1.585 | 0.054 | 16.073 |
| −1.584 | 0.059 | 16.073 |
| −1.580 | 0.067 | 16.073 |
| −1.570 | 0.078 | 16.073 |
| −1.555 | 0.091 | 16.073 |
| −1.533 | 0.106 | 16.073 |
| −1.503 | 0.123 | 16.073 |
| −1.465 | 0.143 | 16.073 |
| −1.418 | 0.163 | 16.073 |
| −1.368 | 0.182 | 16.073 |
| −1.310 | 0.201 | 16.073 |
| −1.246 | 0.218 | 16.073 |
| −1.173 | 0.234 | 16.073 |
| −1.097 | 0.247 | 16.073 |
| −1.017 | 0.258 | 16.073 |
| −0.934 | 0.266 | 16.073 |
| −0.847 | 0.270 | 16.073 |
| −0.756 | 0.273 | 16.073 |
| −0.662 | 0.272 | 16.073 |
| −0.565 | 0.270 | 16.073 |
| −0.464 | 0.267 | 16.073 |
| −0.363 | 0.261 | 16.073 |
| −0.263 | 0.254 | 16.073 |
| −0.163 | 0.246 | 16.073 |
| −0.062 | 0.236 | 16.073 |
| 0.038 | 0.225 | 16.073 |
| 0.138 | 0.213 | 16.073 |
| 0.237 | 0.200 | 16.073 |
| 0.337 | 0.186 | 16.073 |
| 0.437 | 0.171 | 16.073 |
| 0.536 | 0.156 | 16.073 |
| 0.636 | 0.140 | 16.073 |
| 0.732 | 0.124 | 16.073 |
| 0.824 | 0.108 | 16.073 |
| 0.914 | 0.092 | 16.073 |
| 0.999 | 0.077 | 16.073 |
| 1.082 | 0.062 | 16.073 |
| 1.161 | 0.048 | 16.073 |
| 1.237 | 0.034 | 16.073 |
| 1.307 | 0.021 | 16.073 |
| 1.369 | 0.009 | 16.073 |
| 1.425 | −0.001 | 16.073 |
| 1.475 | −0.010 | 16.073 |

TABLE 1-continued

| X | Y | Z |
|---|---|---|
| 1.518 | −0.018 | 16.073 |
| 1.554 | −0.024 | 16.073 |
| 1.585 | −0.030 | 16.073 |
| 1.612 | −0.034 | 16.073 |
| 1.633 | −0.038 | 16.073 |
| 1.650 | −0.041 | 16.073 |
| 1.663 | −0.043 | 16.073 |
| 1.673 | −0.047 | 16.073 |
| 1.678 | −0.054 | 16.073 |
| 1.680 | −0.060 | 16.073 |
| 1.680 | −0.065 | 16.073 |
| 1.679 | −0.070 | 16.073 |
| 1.675 | −0.076 | 16.073 |
| 1.668 | −0.080 | 16.073 |
| 1.658 | −0.081 | 16.073 |
| 1.645 | −0.079 | 16.073 |
| 1.628 | −0.077 | 16.073 |
| 1.607 | −0.074 | 16.073 |
| 1.581 | −0.070 | 16.073 |
| 1.551 | −0.066 | 16.073 |
| 1.515 | −0.061 | 16.073 |
| 1.473 | −0.056 | 16.073 |
| 1.424 | −0.050 | 16.073 |
| 1.368 | −0.044 | 16.073 |
| 1.306 | −0.037 | 16.073 |
| 1.238 | −0.030 | 16.073 |
| 1.162 | −0.023 | 16.073 |
| 1.084 | −0.015 | 16.073 |
| 1.002 | −0.008 | 16.073 |
| 0.917 | −0.001 | 16.073 |
| 0.829 | 0.007 | 16.073 |
| 0.737 | 0.014 | 16.073 |
| 0.642 | 0.021 | 16.073 |
| 0.544 | 0.028 | 16.073 |
| 0.446 | 0.035 | 16.073 |
| 0.347 | 0.041 | 16.073 |
| 0.249 | 0.047 | 16.073 |
| 0.151 | 0.053 | 16.073 |
| 0.052 | 0.058 | 16.073 |
| −0.046 | 0.062 | 16.073 |
| −0.145 | 0.066 | 16.073 |
| −0.243 | 0.070 | 16.073 |
| −0.341 | 0.072 | 16.073 |
| −0.440 | 0.075 | 16.073 |
| −0.538 | 0.076 | 16.073 |
| −0.634 | 0.076 | 16.073 |
| −0.726 | 0.076 | 16.073 |
| −0.814 | 0.075 | 16.073 |
| −0.900 | 0.074 | 16.073 |
| −0.982 | 0.072 | 16.073 |
| −1.061 | 0.070 | 16.073 |
| −1.136 | 0.067 | 16.073 |
| −1.209 | 0.063 | 16.073 |
| −1.274 | 0.058 | 16.073 |
| −1.333 | 0.053 | 16.073 |
| −1.385 | 0.048 | 16.073 |
| −1.434 | 0.043 | 16.073 |
| −1.477 | 0.040 | 16.073 |
| −1.510 | 0.037 | 16.073 |
| −1.536 | 0.036 | 16.073 |
| −1.556 | 0.037 | 16.073 |
| −1.570 | 0.039 | 16.073 |
| −1.578 | 0.042 | 16.073 |
| −1.582 | 0.046 | 16.073 |
| −1.584 | 0.048 | 16.073 |
| −1.584 | 0.049 | 16.073 |
| −1.585 | 0.050 | 16.073 |
| | Section Z-Z | |
| −1.515 | 0.043 | 16.609 |
| −1.516 | 0.045 | 16.609 |
| −1.516 | 0.047 | 16.609 |
| −1.515 | 0.053 | 16.609 |
| −1.511 | 0.060 | 16.609 |
| −1.502 | 0.071 | 16.609 |
| −1.487 | 0.084 | 16.609 |
| −1.465 | 0.099 | 16.609 |
| −1.437 | 0.116 | 16.609 |

TABLE 1-continued

| X | Y | Z |
|---|---|---|
| −1.399 | 0.136 | 16.609 |
| −1.354 | 0.156 | 16.609 |
| −1.305 | 0.176 | 16.609 |
| −1.249 | 0.195 | 16.609 |
| −1.186 | 0.214 | 16.609 |
| −1.115 | 0.231 | 16.609 |
| −1.041 | 0.246 | 16.609 |
| −0.963 | 0.258 | 16.609 |
| −0.882 | 0.267 | 16.609 |
| −0.796 | 0.274 | 16.609 |
| −0.708 | 0.278 | 16.609 |
| −0.616 | 0.280 | 16.609 |
| −0.520 | 0.280 | 16.609 |
| −0.422 | 0.278 | 16.609 |
| −0.323 | 0.274 | 16.609 |
| −0.225 | 0.268 | 16.609 |
| −0.126 | 0.261 | 16.609 |
| −0.028 | 0.253 | 16.609 |
| 0.070 | 0.243 | 16.609 |
| 0.168 | 0.232 | 16.609 |
| 0.266 | 0.220 | 16.609 |
| 0.364 | 0.207 | 16.609 |
| 0.461 | 0.193 | 16.609 |
| 0.559 | 0.179 | 16.609 |
| 0.656 | 0.163 | 16.609 |
| 0.751 | 0.148 | 16.609 |
| 0.841 | 0.133 | 16.609 |
| 0.929 | 0.118 | 16.609 |
| 1.013 | 0.104 | 16.609 |
| 1.094 | 0.089 | 16.609 |
| 1.172 | 0.076 | 16.609 |
| 1.246 | 0.062 | 16.609 |
| 1.314 | 0.050 | 16.609 |
| 1.376 | 0.039 | 16.609 |
| 1.431 | 0.029 | 16.609 |
| 1.479 | 0.020 | 16.609 |
| 1.521 | 0.012 | 16.609 |
| 1.557 | 0.006 | 16.609 |
| 1.587 | 0.001 | 16.609 |
| 1.613 | −0.004 | 16.609 |
| 1.634 | −0.007 | 16.609 |
| 1.651 | −0.010 | 16.609 |
| 1.664 | −0.013 | 16.609 |
| 1.673 | −0.016 | 16.609 |
| 1.678 | −0.023 | 16.609 |
| 1.680 | −0.029 | 16.609 |
| 1.680 | −0.034 | 16.609 |
| 1.679 | −0.039 | 16.609 |
| 1.675 | −0.044 | 16.609 |
| 1.669 | −0.048 | 16.609 |
| 1.659 | −0.050 | 16.609 |
| 1.646 | −0.048 | 16.609 |
| 1.630 | −0.045 | 16.609 |
| 1.609 | −0.042 | 16.609 |
| 1.584 | −0.039 | 16.609 |
| 1.554 | −0.035 | 16.609 |
| 1.519 | −0.030 | 16.609 |
| 1.478 | −0.025 | 16.609 |
| 1.430 | −0.019 | 16.609 |
| 1.375 | −0.013 | 16.609 |
| 1.315 | −0.007 | 16.609 |
| 1.247 | 0.000 | 16.609 |
| 1.174 | 0.007 | 16.609 |
| 1.097 | 0.014 | 16.609 |
| 1.017 | 0.021 | 16.609 |
| 0.934 | 0.028 | 16.609 |
| 0.847 | 0.034 | 16.609 |
| 0.757 | 0.041 | 16.609 |
| 0.664 | 0.047 | 16.609 |
| 0.568 | 0.054 | 16.609 |
| 0.472 | 0.059 | 16.609 |
| 0.375 | 0.065 | 16.609 |
| 0.279 | 0.070 | 16.609 |
| 0.183 | 0.075 | 16.609 |
| 0.087 | 0.079 | 16.609 |
| −0.010 | 0.083 | 16.609 |
| −0.106 | 0.086 | 16.609 |
| −0.203 | 0.088 | 16.609 |

TABLE 1-continued

| X | Y | Z |
|---|---|---|
| −0.299 | 0.089 | 16.609 |
| −0.395 | 0.090 | 16.609 |
| −0.492 | 0.089 | 16.609 |
| −0.585 | 0.088 | 16.609 |
| −0.675 | 0.086 | 16.609 |
| −0.762 | 0.083 | 16.609 |
| −0.846 | 0.080 | 16.609 |
| −0.926 | 0.077 | 16.609 |
| −1.003 | 0.073 | 16.609 |
| −1.077 | 0.068 | 16.609 |
| −1.147 | 0.062 | 16.609 |
| −1.212 | 0.056 | 16.609 |
| −1.269 | 0.050 | 16.609 |
| −1.320 | 0.045 | 16.609 |
| −1.368 | 0.039 | 16.609 |
| −1.410 | 0.035 | 16.609 |
| −1.442 | 0.032 | 16.609 |
| −1.468 | 0.030 | 16.609 |
| −1.487 | 0.030 | 16.609 |
| −1.501 | 0.033 | 16.609 |
| −1.509 | 0.036 | 16.609 |
| −1.513 | 0.039 | 16.609 |
| −1.514 | 0.041 | 16.609 |
| −1.515 | 0.042 | 16.609 |
| −1.515 | 0.043 | 16.609 |
| Section AA-AA | | |
| −1.446 | 0.037 | 17.145 |
| −1.446 | 0.038 | 17.145 |
| −1.447 | 0.040 | 17.145 |
| −1.446 | 0.046 | 17.145 |
| −1.442 | 0.053 | 17.145 |
| −1.433 | 0.064 | 17.145 |
| −1.418 | 0.077 | 17.145 |
| −1.397 | 0.092 | 17.145 |
| −1.369 | 0.109 | 17.145 |
| −1.332 | 0.129 | 17.145 |
| −1.288 | 0.150 | 17.145 |
| −1.241 | 0.170 | 17.145 |
| −1.186 | 0.190 | 17.145 |
| −1.124 | 0.210 | 17.145 |
| −1.056 | 0.228 | 17.145 |
| −0.984 | 0.244 | 17.145 |
| −0.908 | 0.258 | 17.145 |
| −0.829 | 0.269 | 17.145 |
| −0.746 | 0.278 | 17.145 |
| −0.659 | 0.284 | 17.145 |
| −0.568 | 0.287 | 17.145 |
| −0.475 | 0.289 | 17.145 |
| −0.378 | 0.289 | 17.145 |
| −0.281 | 0.287 | 17.145 |
| −0.184 | 0.283 | 17.145 |
| −0.088 | 0.277 | 17.145 |
| 0.008 | 0.270 | 17.145 |
| 0.104 | 0.261 | 17.145 |
| 0.200 | 0.251 | 17.145 |
| 0.296 | 0.240 | 17.145 |
| 0.392 | 0.228 | 17.145 |
| 0.487 | 0.215 | 17.145 |
| 0.583 | 0.201 | 17.145 |
| 0.678 | 0.187 | 17.145 |
| 0.770 | 0.173 | 17.145 |
| 0.859 | 0.158 | 17.145 |
| 0.945 | 0.144 | 17.145 |
| 1.027 | 0.130 | 17.145 |
| 1.106 | 0.117 | 17.145 |
| 1.182 | 0.103 | 17.145 |
| 1.255 | 0.091 | 17.145 |
| 1.322 | 0.079 | 17.145 |
| 1.382 | 0.068 | 17.145 |
| 1.436 | 0.058 | 17.145 |
| 1.483 | 0.050 | 17.145 |
| 1.525 | 0.042 | 17.145 |
| 1.559 | 0.036 | 17.145 |
| 1.589 | 0.031 | 17.145 |
| 1.614 | 0.027 | 17.145 |
| 1.635 | 0.023 | 17.145 |
| 1.651 | 0.020 | 17.145 |

TABLE 1-continued

| X | Y | Z |
|---|---|---|
| 1.664 | 0.018 | 17.145 |
| 1.673 | 0.014 | 17.145 |
| 1.678 | 0.008 | 17.145 |
| 1.680 | 0.002 | 17.145 |
| 1.680 | −0.003 | 17.145 |
| 1.679 | −0.008 | 17.145 |
| 1.675 | −0.013 | 17.145 |
| 1.669 | −0.017 | 17.145 |
| 1.659 | −0.018 | 17.145 |
| 1.647 | −0.017 | 17.145 |
| 1.631 | −0.014 | 17.145 |
| 1.611 | −0.011 | 17.145 |
| 1.586 | −0.008 | 17.145 |
| 1.557 | −0.004 | 17.145 |
| 1.522 | 0.000 | 17.145 |
| 1.482 | 0.006 | 17.145 |
| 1.435 | 0.011 | 17.145 |
| 1.382 | 0.017 | 17.145 |
| 1.322 | 0.023 | 17.145 |
| 1.257 | 0.030 | 17.145 |
| 1.184 | 0.036 | 17.145 |
| 1.109 | 0.043 | 17.145 |
| 1.031 | 0.049 | 17.145 |
| 0.949 | 0.055 | 17.145 |
| 0.865 | 0.062 | 17.145 |
| 0.777 | 0.068 | 17.145 |
| 0.686 | 0.073 | 17.145 |
| 0.591 | 0.079 | 17.145 |
| 0.497 | 0.084 | 17.145 |
| 0.403 | 0.089 | 17.145 |
| 0.309 | 0.093 | 17.145 |
| 0.215 | 0.097 | 17.145 |
| 0.120 | 0.101 | 17.145 |
| 0.026 | 0.103 | 17.145 |
| −0.068 | 0.105 | 17.145 |
| −0.163 | 0.106 | 17.145 |
| −0.257 | 0.106 | 17.145 |
| −0.351 | 0.106 | 17.145 |
| −0.445 | 0.104 | 17.145 |
| −0.537 | 0.101 | 17.145 |
| −0.625 | 0.097 | 17.145 |
| −0.710 | 0.092 | 17.145 |
| −0.791 | 0.087 | 17.145 |
| −0.870 | 0.082 | 17.145 |
| −0.945 | 0.076 | 17.145 |
| −1.017 | 0.069 | 17.145 |
| −1.086 | 0.062 | 17.145 |
| −1.149 | 0.055 | 17.145 |
| −1.205 | 0.048 | 17.145 |
| −1.255 | 0.041 | 17.145 |
| −1.302 | 0.035 | 17.145 |
| −1.343 | 0.030 | 17.145 |
| −1.374 | 0.026 | 17.145 |
| −1.399 | 0.024 | 17.145 |
| −1.418 | 0.024 | 17.145 |
| −1.432 | 0.026 | 17.145 |
| −1.439 | 0.029 | 17.145 |
| −1.443 | 0.032 | 17.145 |
| −1.445 | 0.034 | 17.145 |
| −1.446 | 0.035 | 17.145 |
| −1.446 | 0.036 | 17.145 |
| Section BB-BB | | |
| −1.381 | 0.030 | 17.645 |
| −1.382 | 0.031 | 17.645 |
| −1.382 | 0.034 | 17.645 |
| −1.381 | 0.039 | 17.645 |
| −1.378 | 0.046 | 17.645 |
| −1.369 | 0.057 | 17.645 |
| −1.354 | 0.070 | 17.645 |
| −1.334 | 0.085 | 17.645 |
| −1.307 | 0.102 | 17.645 |
| −1.271 | 0.122 | 17.645 |
| −1.228 | 0.144 | 17.645 |
| −1.182 | 0.164 | 17.645 |
| −1.128 | 0.185 | 17.645 |
| −1.069 | 0.205 | 17.645 |
| −1.002 | 0.225 | 17.645 |

TABLE 1-continued

| X | Y | Z |
|---|---|---|
| −0.932 | 0.242 | 17.645 |
| −0.858 | 0.258 | 17.645 |
| −0.780 | 0.271 | 17.645 |
| −0.699 | 0.281 | 17.645 |
| −0.613 | 0.289 | 17.645 |
| −0.525 | 0.294 | 17.645 |
| −0.433 | 0.298 | 17.645 |
| −0.338 | 0.300 | 17.645 |
| −0.243 | 0.299 | 17.645 |
| −0.148 | 0.296 | 17.645 |
| −0.054 | 0.292 | 17.645 |
| 0.040 | 0.286 | 17.645 |
| 0.135 | 0.278 | 17.645 |
| 0.229 | 0.268 | 17.645 |
| 0.323 | 0.258 | 17.645 |
| 0.416 | 0.247 | 17.645 |
| 0.510 | 0.235 | 17.645 |
| 0.604 | 0.222 | 17.645 |
| 0.697 | 0.209 | 17.645 |
| 0.788 | 0.196 | 17.645 |
| 0.875 | 0.182 | 17.645 |
| 0.959 | 0.169 | 17.645 |
| 1.040 | 0.155 | 17.645 |
| 1.118 | 0.142 | 17.645 |
| 1.192 | 0.129 | 17.645 |
| 1.264 | 0.117 | 17.645 |
| 1.329 | 0.105 | 17.645 |
| 1.388 | 0.095 | 17.645 |
| 1.441 | 0.086 | 17.645 |
| 1.487 | 0.077 | 17.645 |
| 1.528 | 0.070 | 17.645 |
| 1.562 | 0.064 | 17.645 |
| 1.591 | 0.059 | 17.645 |
| 1.616 | 0.055 | 17.645 |
| 1.636 | 0.051 | 17.645 |
| 1.652 | 0.048 | 17.645 |
| 1.664 | 0.046 | 17.645 |
| 1.673 | 0.043 | 17.645 |
| 1.678 | 0.036 | 17.645 |
| 1.680 | 0.030 | 17.645 |
| 1.680 | 0.026 | 17.645 |
| 1.679 | 0.021 | 17.645 |
| 1.675 | 0.016 | 17.645 |
| 1.669 | 0.012 | 17.645 |
| 1.660 | 0.011 | 17.645 |
| 1.648 | 0.013 | 17.645 |
| 1.632 | 0.015 | 17.645 |
| 1.612 | 0.018 | 17.645 |
| 1.588 | 0.021 | 17.645 |
| 1.559 | 0.025 | 17.645 |
| 1.525 | 0.029 | 17.645 |
| 1.486 | 0.034 | 17.645 |
| 1.440 | 0.039 | 17.645 |
| 1.388 | 0.045 | 17.645 |
| 1.329 | 0.051 | 17.645 |
| 1.265 | 0.057 | 17.645 |
| 1.194 | 0.063 | 17.645 |
| 1.121 | 0.070 | 17.645 |
| 1.044 | 0.076 | 17.645 |
| 0.964 | 0.082 | 17.645 |
| 0.881 | 0.087 | 17.645 |
| 0.795 | 0.092 | 17.645 |
| 0.706 | 0.098 | 17.645 |
| 0.613 | 0.102 | 17.645 |
| 0.521 | 0.107 | 17.645 |
| 0.429 | 0.111 | 17.645 |
| 0.336 | 0.115 | 17.645 |
| 0.244 | 0.118 | 17.645 |
| 0.152 | 0.121 | 17.645 |
| 0.059 | 0.123 | 17.645 |
| −0.033 | 0.124 | 17.645 |
| −0.125 | 0.124 | 17.645 |
| −0.218 | 0.123 | 17.645 |
| −0.310 | 0.120 | 17.645 |
| −0.402 | 0.117 | 17.645 |
| −0.492 | 0.112 | 17.645 |
| −0.578 | 0.107 | 17.645 |
| −0.661 | 0.100 | 17.645 |

TABLE 1-continued

| X | Y | Z |
|---|---|---|
| −0.741 | 0.094 | 17.645 |
| −0.818 | 0.087 | 17.645 |
| −0.892 | 0.079 | 17.645 |
| −0.962 | 0.071 | 17.645 |
| −1.029 | 0.062 | 17.645 |
| −1.091 | 0.054 | 17.645 |
| −1.146 | 0.046 | 17.645 |
| −1.194 | 0.038 | 17.645 |
| −1.240 | 0.031 | 17.645 |
| −1.280 | 0.025 | 17.645 |
| −1.310 | 0.021 | 17.645 |
| −1.335 | 0.019 | 17.645 |
| −1.354 | 0.019 | 17.645 |
| −1.367 | 0.020 | 17.645 |
| −1.375 | 0.023 | 17.645 |
| −1.379 | 0.026 | 17.645 |
| −1.380 | 0.028 | 17.645 |
| −1.381 | 0.029 | 17.645 |
| −1.381 | 0.030 | 17.645 |

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

The invention claimed is:

1. An article of manufacture, at least a portion of the article comprising an airfoil having a nominal profile substantially in accordance with Cartesian coordinate values of x, y, and z set forth in TABLE 1 and a scaling factor, and wherein x and y are distances in inches, within a tolerance, which, when connected by smooth curves, define airfoil profile sections at each distance z in inches, the profile sections at the z distances being joined smoothly with one another to form a complete airfoil shape.

2. The article of manufacture of claim 1 wherein the airfoil is an inlet guide vane.

3. The article of manufacture of claim 2 wherein said article shape lies in an envelope within 0.16 inches in a direction normal to any article surface location.

4. The article of manufacture of claim 1 further comprising a top shaft portion extending from an initial plane of the article manufacture away from the airfoil and a bottom shaft portion extending from a terminal plane of the article of manufacture away from the airfoil coaxial with the top shaft portion such that the airfoil is rotatable about a longitudinal axis of the top and bottom shaft portions.

5. The article of manufacture of claim 1 wherein the scaling factor is 1.

6. The article of manufacture of claim 1 wherein the tolerance is ±0.16 inches.

7. A gas turbine comprising an inlet having a plurality of articles of manufacture, each of said articles of manufacture including an airfoil having an airfoil shape, the airfoil having a nominal profile substantially in accordance with Cartesian coordinate values of x, y, and z set forth in TABLE 1 and a scaling factor, wherein x and y are distances in inches, within a tolerance, which, when connected by smooth curves, define the airfoil profile sections at each distance z in inches, the profile sections at the z distances being joined with one another with smooth surfaces to form a complete airfoil shape.

8. A gas turbine of claim 7, wherein at least one airfoil is an inlet guide vane.

9. The gas turbine of claim 7 wherein each article of manufacture further comprises coaxial top and bottom shaft portions non-rotatably projecting away from respective ends of the airfoil.

10. The gas turbine of claim 9 wherein the top shaft portions are rotatably mounted in one of a casing and a center structure of the gas turbine and the bottom shaft portions are rotatably mounted in another of the casing and the center structure of the gas turbine, the gas turbine further comprising at least one actuator configured to rotate at least one of the shaft portions.

11. The gas turbine of claim 7 wherein the scaling factor is 1.

12. The gas turbine of claim 7 wherein the tolerance is ±0.16 inches.

13. A gas turbine comprising an inlet having a plurality of articles of manufacture disposed therein, each of said articles of manufacture including an airfoil having an uncoated nominal airfoil profile substantially in accordance with Cartesian coordinate values of x, y, and z set forth in TABLE 1, wherein x and y are distances in inches, within a tolerance, which, when connected by smooth curves, define airfoil profile sections at each distance z in inches, the profile sections at the z distances being joined with one another with smooth surfaces to form a complete airfoil shape, the x and y distances being scalable as a function of a scaling factor to provide a scaled-up or scaled-down inlet guide vane airfoil.

14. The gas turbine of claim 13 wherein each of the plurality of articles of manufacture further comprises top and bottom shaft portions projecting away from respective ends of the inlet guide vane airfoil, the top and bottom shaft portions being rotatably mounted in respective ones of a casing and a center structure of the gas turbine.

15. The gas turbine of claim 13 further comprising at least one actuator configured to rotate at least one of the shaft portions, thereby controlling an angle of attack of at least one respective inlet guide vane airfoil.

16. The gas turbine of claim 13 wherein the scaling factor is 1.

17. The gas turbine of claim 13 wherein the tolerance is ±0.16 inches.

* * * * *